US009698505B2

(12) United States Patent
Miyazaki

(10) Patent No.: US 9,698,505 B2
(45) Date of Patent: Jul. 4, 2017

(54) CONNECTOR

(71) Applicant: FUJITSU LIMITED, Kawasaki-shi, Kanagawa (JP)

(72) Inventor: Takehide Miyazaki, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/099,969

(22) Filed: Apr. 15, 2016

(65) Prior Publication Data

US 2016/0336663 A1 Nov. 17, 2016

(30) Foreign Application Priority Data

May 14, 2015 (JP) ..... 2015-099364

(51) Int. Cl.

| | |
|---|---|
| ***H01R 13/42*** | (2006.01) |
| ***H01R 12/58*** | (2011.01) |
| ***H01R 13/41*** | (2006.01) |
| ***H01R 43/20*** | (2006.01) |

(52) U.S. Cl.

CPC ..... *H01R 12/585* (2013.01); *H01R 13/41* (2013.01); *H01R 43/205* (2013.01)

(58) Field of Classification Search

CPC .. H01R 43/205; H01R 12/585; H01R 13/415; H01R 13/04; H05K 3/306

USPC ..... 439/751

See application file for complete search history.

(56) References Cited

U.S. PATENT DOCUMENTS

| | | | | |
|---|---|---|---|---|
| 4,550,962 | A * | 11/1985 | Czeschka | H01R 12/585 29/739 |
| 7,243,422 | B2 * | 7/2007 | Ikeda | H01R 43/205 29/33 M |
| 2002/0104683 | A1 | 8/2002 | Teshima et al. | |
| 2012/0252284 | A1 | 10/2012 | Kato | |

FOREIGN PATENT DOCUMENTS

| | | |
|---|---|---|
| JP | 2002-185098 | 6/2002 |
| JP | 2002-237664 | 8/2002 |
| JP | 2012-216293 | 11/2012 |

* cited by examiner

*Primary Examiner* — Jean F Duverne
(74) *Attorney, Agent, or Firm* — Staas & Halsey LLP

(57) ABSTRACT

A connector includes: a press-fit pin including a press-fit portion configured to be press-fitted into a through-hole of a circuit board and a pressed portion configured to be coupled to the press-fit portion and receive a pressing force for press-fitting the press-fit portion into the through-hole; and a press-fit member including a through-hole configured to removably hold the press-fit pin and a pressing portion configured to transfer the pressing force to the pressed portion of the press-fit pin held in the through-hole such that the press-fit portion protrudes.

1 Claim, 23 Drawing Sheets

CONNECTOR

CROSS-REFERENCE TO RELATED APPLICATION

This application is based upon and claims the benefit of priority of the prior Japanese Patent Application No. 2015-099364, filed on May 14, 2015, the entire contents of which are incorporated herein by reference.

FIELD

The embodiments discussed herein are related to a connector.

BACKGROUND

There is known a connector mounted to a circuit board in a press-fit manner. For example, a connector 200 illustrated in FIG. 1 includes a press-fit pin 201 press-fitted into a through-hole 101 formed in a circuit board 100. The press-fit pin 201 is formed such that its distal end portion to be inserted into the through-hole 101 has a width larger than an inner diameter of the through-hole 101 and is elastically deformable. When the distal end portion of the press-fit pin 201 is inserted into the through-hole 101, the distal end portion is pressed against the inner wall surface of the through-hole 101 such that electrical conduction is ensured.

In the press-fit-type connector 200, when the press-fit pin 201 is press-fitted into the through-hole 101, the distal end portion of the press-fit pin 201 may abut against an edge portion of the through-hole 101 and buckle without being properly inserted. This may be caused, for example, when the distal end portion is bent in a manufacturing process of the press-fit pin 201. It is also considered that the press-fit pin 201 buckles due to a worker's inadvertent handling such as, for example, touching the distal end portion or causing the distal end portion to come into contact with something during the press-fitting of the press-fit pin 201. Thus, after the press-fit pin 201 is press-fitted, the rear surface side of a circuit board 100 is visually observed, and the presence or absence of buckling of the press-fit pin 201 is determined based on whether the distal end portion of the press-fit pin 201 protrudes from the rear surface of the circuit board 100.

However, in recent years, the length of such a press-fit pin 201 has been shortened according to high-speed signal transmission. As illustrated in FIG. 2, there is a case in which the distal end portion of the press-fit pin 201 inserted into the through-hole 101 may not protrude from the rear surface of the circuit board 100. In such a case, it becomes difficult to confirm the presence or absence of the press-fit pin 201 by a visual observation.

Furthermore, in recent years, there is also a case in which connectors 200 are provided on the front and rear surfaces of a circuit board 100 and press-fit pins 201 are press-fitted at the opposite sides of the same through-hole 101. In such a case, it was conventionally difficult to confirm, by a visual observation, the presence or absence of buckling of the press-fit pin 201 press-fitted into the same through-hole 101 from the rear side.

In this regard, there is a case in which a conduction failure caused by the buckling of the press-fit pin 201 may be detected by performing a conduction test of the press-fit pin 201 and the circuit board 100 after the press-fit pin 201 is press-fitted. However, even in this case, it is necessary to repeat a press-fitting work of the press-fit pin 201, which may cause the degradation of production efficiency. Moreover, there is a case in which a press-fit pin 201 passes a conduction test even though the press-fit pin 201 is buckling after it is press-fitted. In this case, the press-fit pin 201 and the circuit board 100 may be insulated due to environmental factors such as, for example, temperature fluctuation and vibration generated after shipping of a product, and a conduction failure may be generated in the shipped product.

In connection with this, there has been proposed a connector in which a through-window is provided in a press-fit portion that holds a press-fit pin to check the buckling of the press-fit pin.

When it happens that a buckling press-fit pin exists in the position of the through-window, the buckling of the press-fit pin may be found. However, when the position of the buckling press-fit pin is different from that of the through-window, it is difficult to find the buckling of the press-fit pin. In addition, the work of confirming the presence or absence of buckling in the press-fit pin by looking in the through-window is never easy from the beginning since it takes much time and effort.

The followings are reference documents.

[Document 1] Japanese Laid-Open Patent Publication No. 2012-216293 and

[Document 2] Japanese Laid-Open Patent Publication No. 2002-237664.

SUMMARY

According to an aspect of the invention, a connector includes: a press-fit pin including a press-fit portion configured to be press-fitted into a through-hole of a circuit board and a pressed portion configured to be coupled to the press-fit portion and receive a pressing force for press-fitting the press-fit portion into the through-hole; and a press-fit member including a through-hole configured to removably hold the press-fit pin and a pressing portion configured to transfer the pressing force to the pressed portion of the press-fit pin held in the through-hole such that the press-fit portion protrudes.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, embodiments of the present disclosure will be described in detail with reference to the drawings.

<Embodiment 1>

Figure 1:
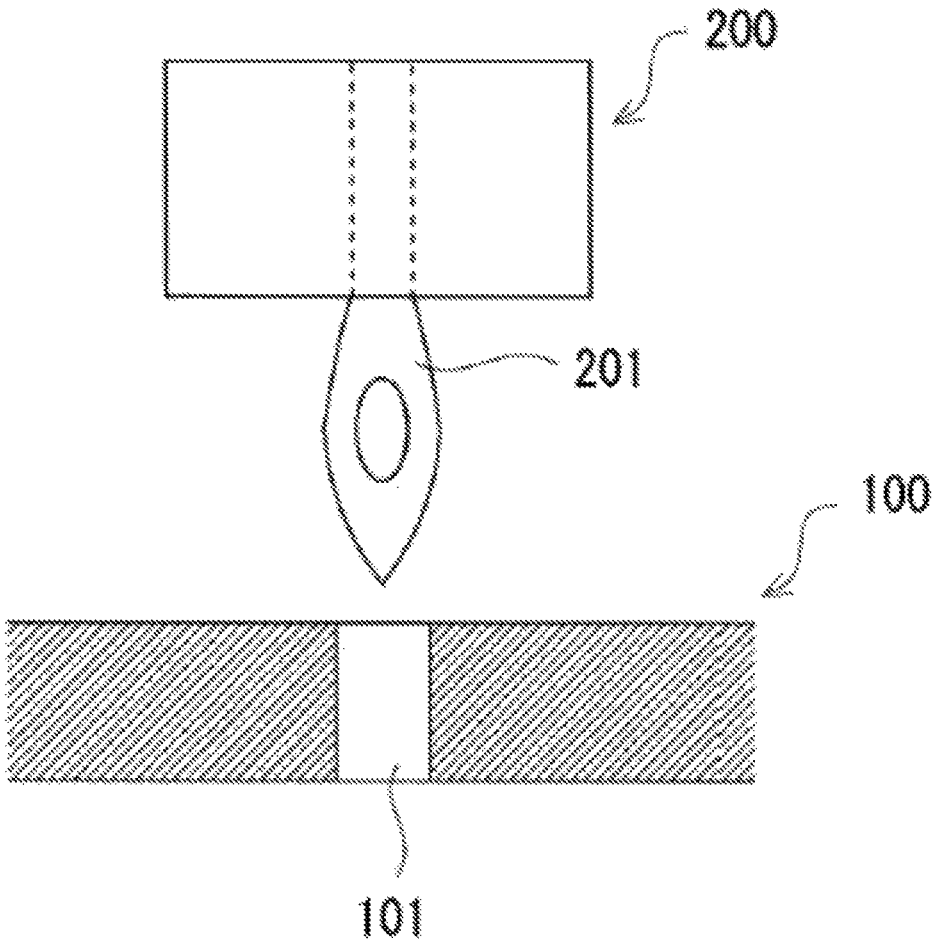
FIG. 1 is a view illustrating a press-fit-type connector of related art (1)
Figure 2:
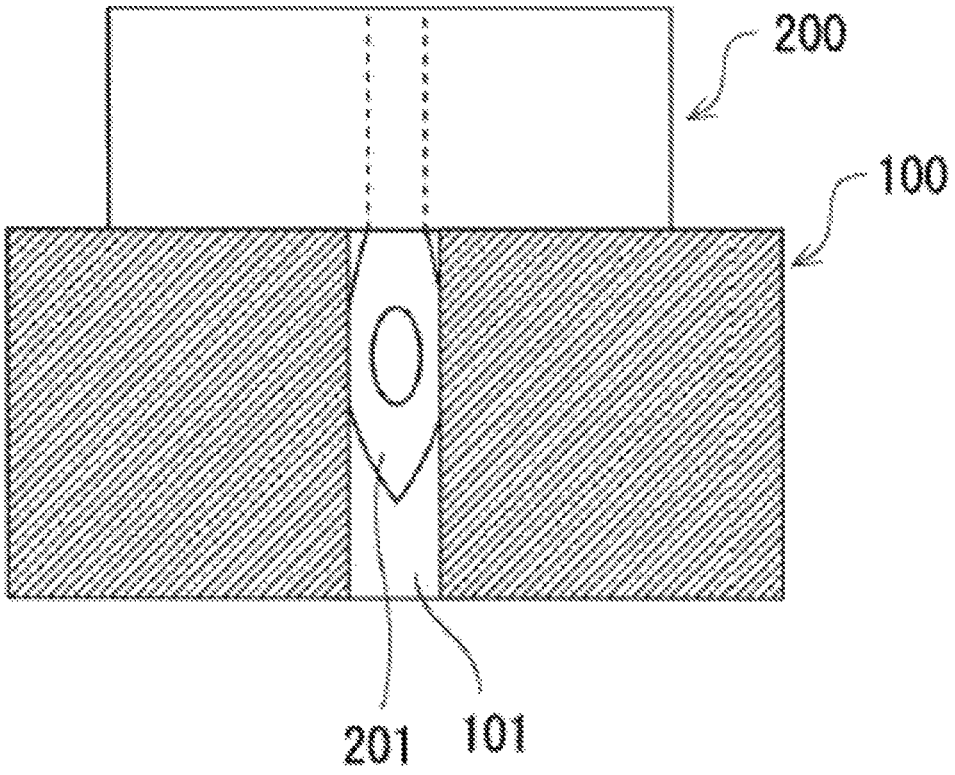
FIG. 2 is a view illustrating the press-fit-type connector of related art (2)
Figure 3:
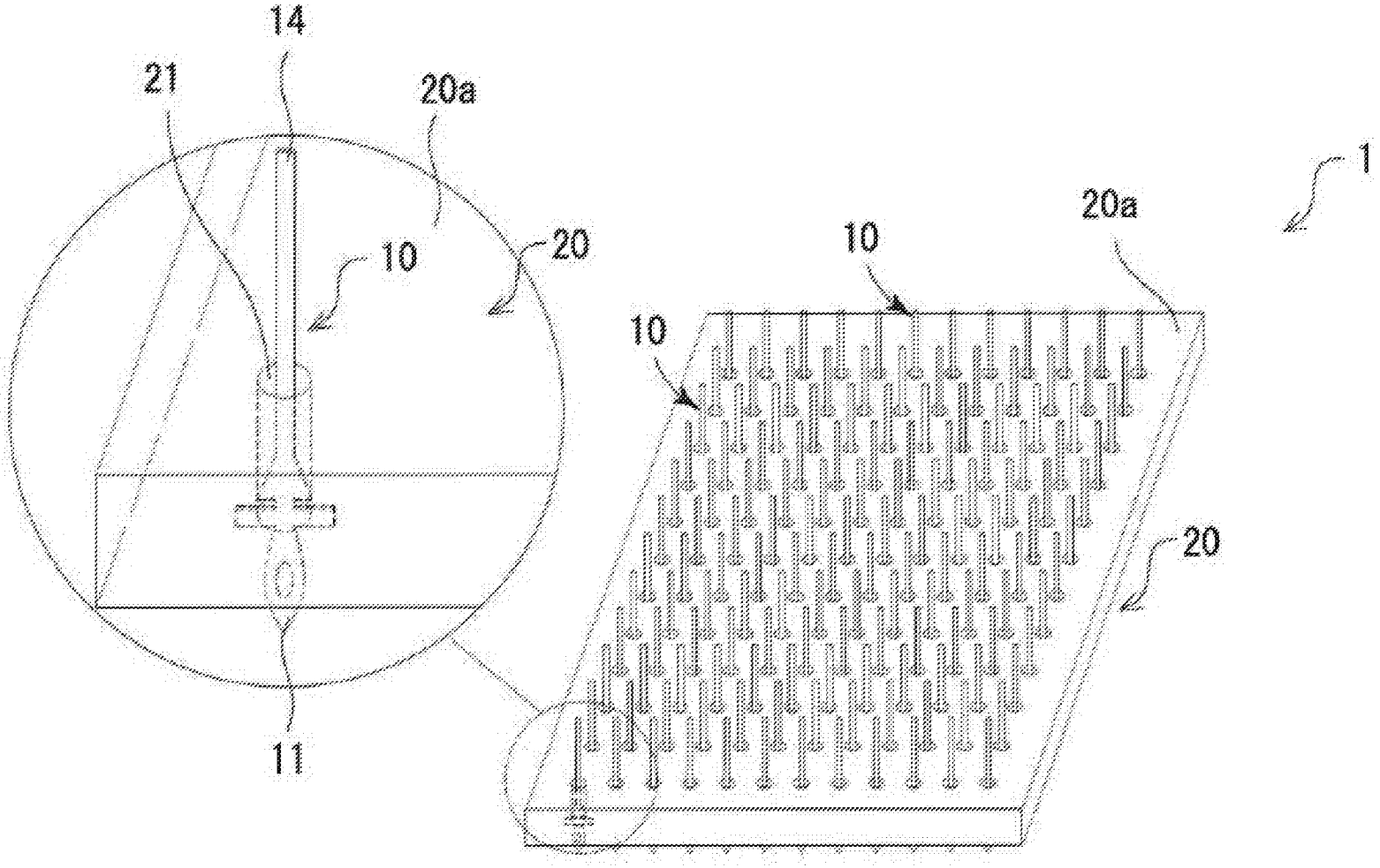
FIG. 3 is a view illustrating a press-fit sheet mounted with press-fit pins in a press-fit-type connector according to Embodiment 1.
Figure 4:
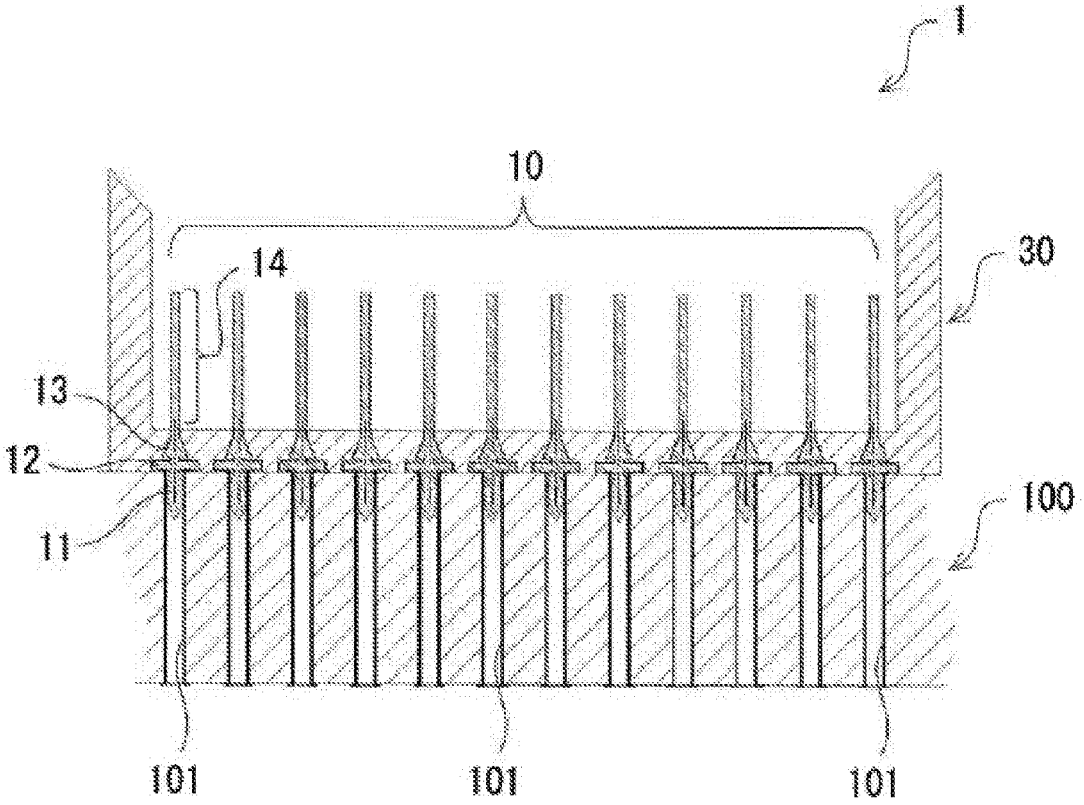
FIG. 4 is a view illustrating a state in which the connector according to Embodiment 1 is attached to a circuit board.

FIG. 3 is a view illustrating a press-fit sheet 20 that is mounted with press-fit pins 10 in a press-fit-type connector 1 according to Embodiment 1. FIG. 4 is a view illustrating a state in which the connector 1 according to Embodiment 1 is attached to a circuit board 100. The connector 1 includes, for example, a plurality of press-fit pins 10, a press-fit sheet 20 configured to hold the press-fit pins 10 to press-fit the press-fit pins 10 to through-holes 101 of a circuit board 100, and a housing 30. The press-fit sheet 20 is an exemplary press-fit member.

The circuit board 100 is, for example, a printed wiring board. The through-holes 101 are electrically connected to a circuit of the circuit board 100. The connector 1 is a component which fixes the press-fit pins 10 to the through-holes 101 of the circuit board 100 in a press-fit manner and electrically interconnects, for example, an external circuit connected to the connector 1 and a circuit of the circuit board 100.

Referring to FIG. 4, each press-fit pin 10 includes a press-fit portion 11, a flange portion 12, a widened portion 13, and a connection pin portion 14, which are formed in this order from the base end side to the distal end side of the press-fit pin 10. The press-fit portion 11 is provided at the base end side of the press-fit pin 10, and press-fitted into one of the through-holes 101. The press-fit portion 11 has an outer periphery whose size is partially enlarged to be elastically deformable in a diameter reduction direction. When fixing the connector 1 to the circuit board 100, the outer circumferential surfaces of the press-fit portions 11 are pressed against the inner wall surfaces of the through-holes 101 to ensure electric conduction merely by press-fitting the press-fit portions 11 into the through-holes 101, respectively. Here, the number of terminals of the connector 1, i.e. the number of the press-fit pins 10, is not limited to a specific number.

The flange portion 12 is formed at a predetermined position on each press-fit pin 10 to define the insertion depth of the press-fit pin 10 by abutting against an edge portion of one of the through-holes 101. The flange portion 12 has a flange shape and is wider than the diameter of the through-hole 101 such that the width dimension of the flange portion 12 is larger than the diameter of the through-hole 101.

The housing 30 is, for example, a holder member which has a shape and a size corresponding to those of an external component connected to the connector 1. In the connector 1, the press-fit pins 10 are press-fitted and fixed into the respective through-holes 101 using the press-fit sheet 20 illustrated in FIG. 3, then the press-fit sheet 20 is removed from the press-fit pins 10, and then, the respective press-fit pins 10 are mounted to the housing 30.

First, descriptions will be made on the order of press-fitting the press-fit pins 10 into the through-holes 101 of the circuit board 100 using the press-fit sheet 20. The press-fit sheet 20 is a sheet-shaped member having through-holes 21 configured to removably hold the press-fit pins 10 of the connector 1. As for the press-fit sheet 20, an elastic material such as, for example, a molded resin may be used. Furthermore, the press-fit sheet 20 has the through-holes 21 whose number corresponds to the number of terminals of the connector 1, i.e. the number of the press-fit pins 10. As illustrated in FIG. 3, the press-fit pins 10 are arranged in a grid form and held by the press-fit sheet 20.

Figure 5:
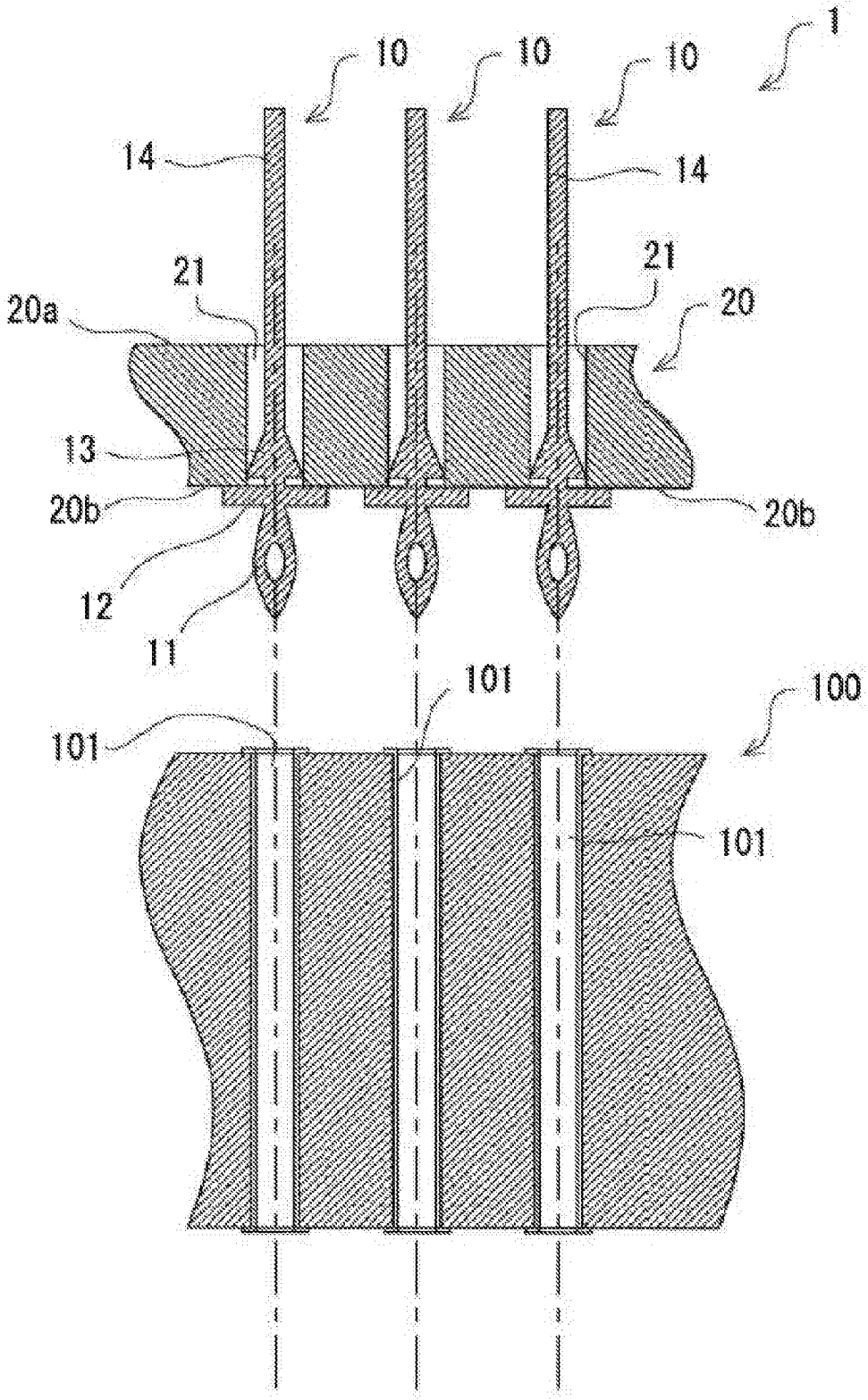
FIG. 5 is a view illustrating a press-fitting process of the press-fit pins according to Embodiment 1 (1)

FIGS. 5 to 8 are views illustrating a press-fit process in which the press-fit pins 10 are press-fitted into the through-holes 101 of the circuit board 100 by the press-fit sheet 20 according to Embodiment 1. As illustrated in FIGS. 3 and 5, the connection pin portions 14 of the press-fit pins 10 protrude to the outside of the through-holes 21 from the upper surface 20*a* side of the press-fit sheet 20. Furthermore, the flange portions 12 and the press-fit portions 11 of the press-fit pins 10 protrude to the outside of the through-holes 21 from the lower surface 20*b* side of the press-fit sheet 20.

Figure 6:
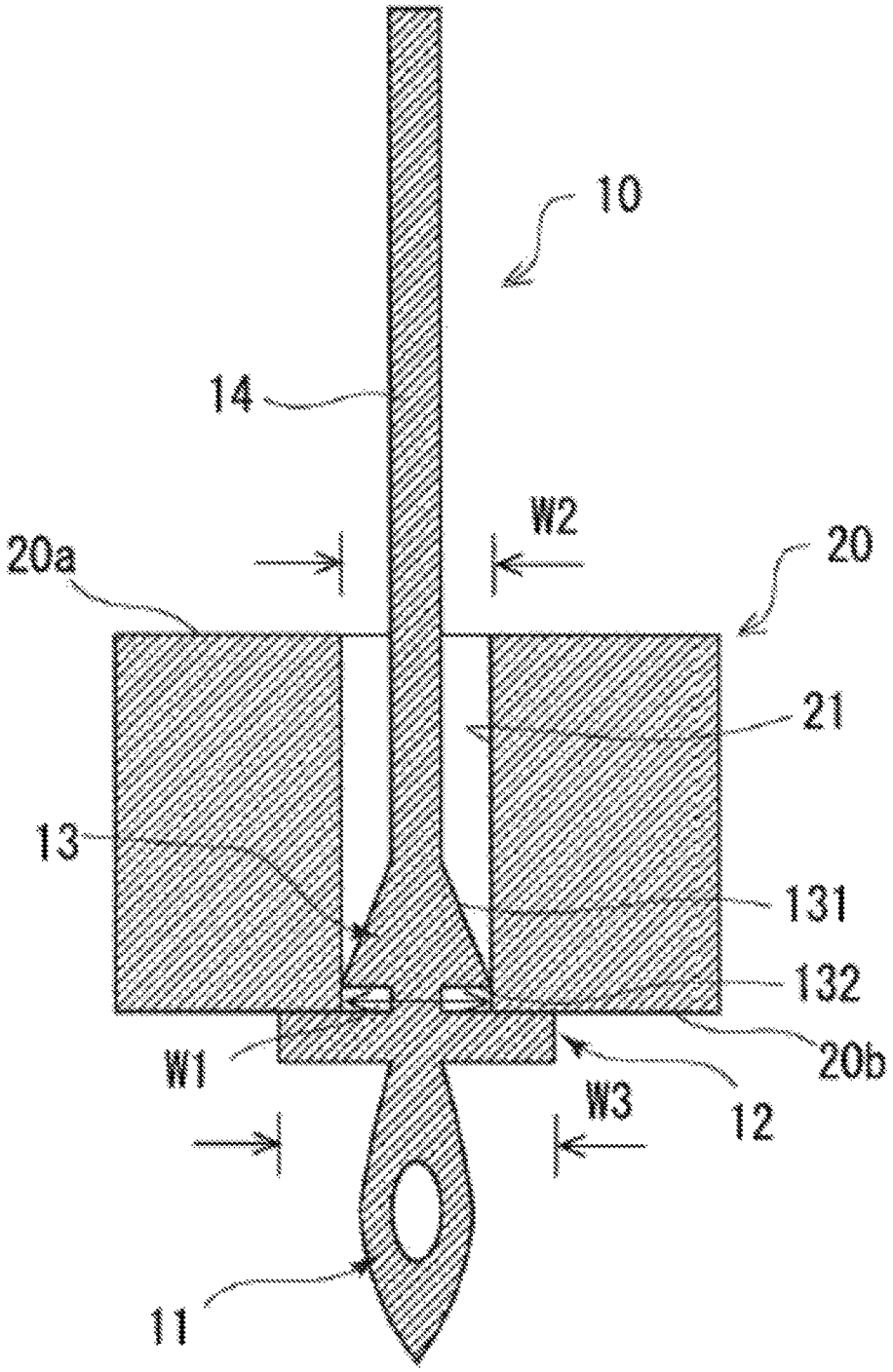
FIG. 6 is a view illustrating the press-fitting process of the press-fit pins according to Embodiment 1 (2)

As illustrated in FIG. 5, the press-fit sheet 20 according to the present embodiment is capable of removably holding the press-fit pins 10 in the through-holes 21 thereof. FIG. 6 is a view illustrating a detailed structure of a press-fit pin 10 according to Embodiment 1.

The widened portion 13 of the press-fit pin 10 is formed as a portion whose width dimension is larger than that of the connection pin portion 14. The term "width dimension" used herein refers to a dimension in a direction orthogonal to a longitudinal axis of the press-fit pin 10. In the present embodiment, the widened portion 13 of the press-fit pin 10 has a tapered surface 131 whose width gradually increases toward the press-fit portion 11. The tapered surface 131 of the widened portion 13 has a largest width dimension at the lower end position thereof. In the following descriptions, the largest dimension of the widened portion 13 will be referred to as an "widened portion largest width dimension W1." Furthermore, a locking surface 132 orthogonal to the longitudinal axis of the press-fit pin 10 is formed at the press-fit-portion side end of the widened portion 13, i.e. at the lower end of the tapered surface 131. Details of the locking surface 132 will be described later. When mounting the housing 30 to the press-fit pins 10, the housing 30 is locked by the locking surfaces 132, thereby suppressing the housing 30 from being released from the press-fit pins 10. In the present embodiment, the locking surface 132 is an exemplary locking portion.

In the present embodiment, the widened portion largest width dimension W1 of the widened portion 13 is set to a dimension that is slightly larger than the through-hole diameter W2 that is a diameter of the through-holes 21 of the press-fit sheet 20 (W1>W2). Thus, when the press-fit pins 10 are inserted into the through-holes 21 of the press-fit sheet 20, the press-fit pins 10 is capable of being held on the press-fit sheet 20 without dropped by their own weight. Furthermore, in a subsequent process, the holding force may be adjusted to such a level that the press-fit sheet 20 can be manually removed from the press-fit pins 10 after the press-fit pins 10 are press-fitted into the through-holes 101. Moreover, in the present embodiment, the flange portion width dimension W3, which is the width dimension of the flange portion 12, is set to a dimension larger than the through-hole diameter W2 (W3>W2).

Figure 7:
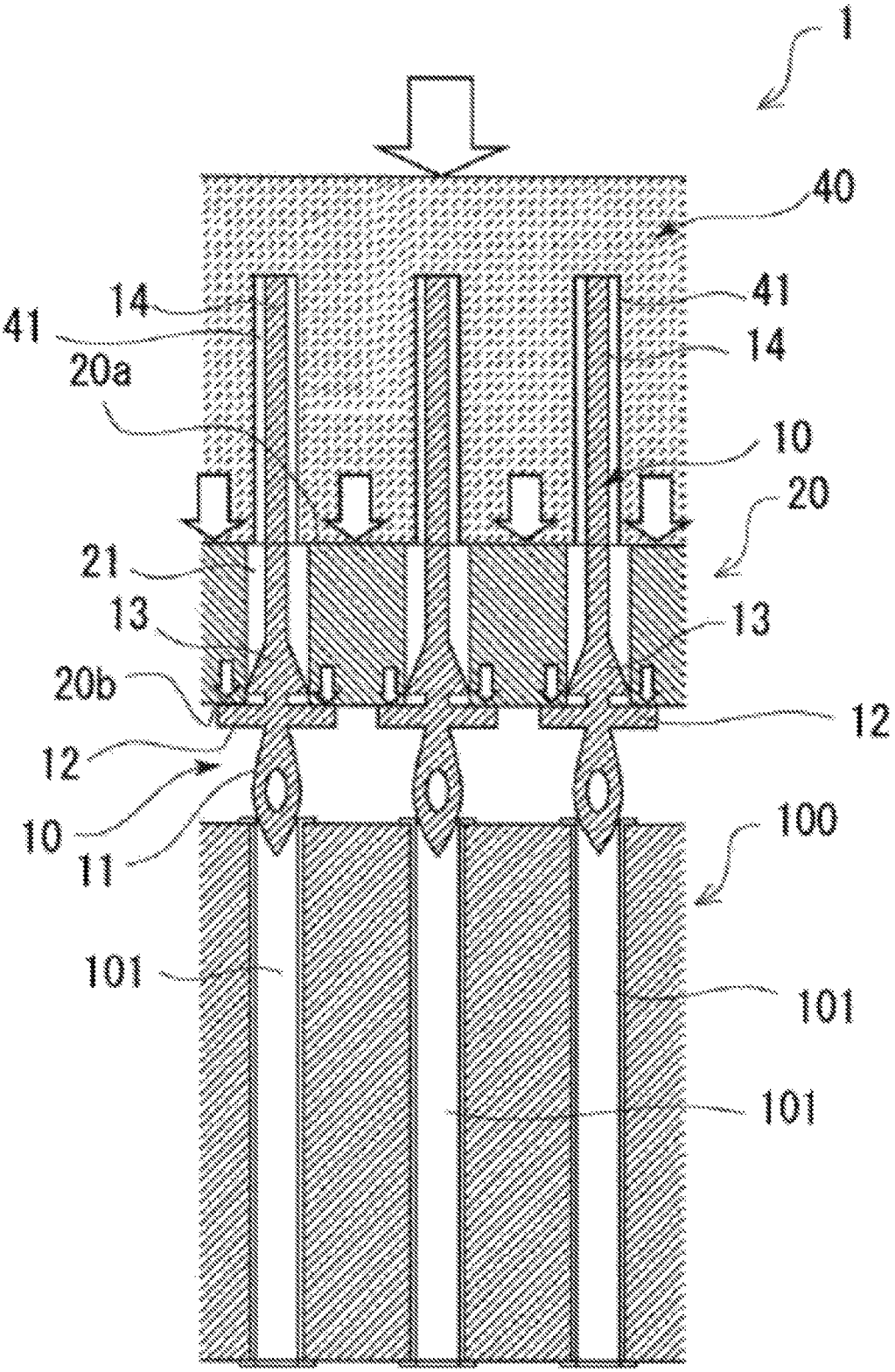
FIG. 7 is a view illustrating the press-fitting process of the press-fit pins according to Embodiment 1 (3)

Subsequently, as illustrated in FIG. 7, the positions of the press-fit pins 10 mounted to the press-fit sheet 20 are aligned with the through-holes 101 of the circuit board 100, and the press-fit sheet 20 is temporarily kept on the circuit board 100. Since the widened portion largest width dimension W1 of the press-fit pins 10 is a slightly larger than the through-hole diameter W2 of the press-fit sheet 20, the press-fit pins 10 are capable of temporarily keeping the press-fit sheet 20 on the circuit board 100 without being dropped from the press-fit sheet 20 by their own weight. In the present embodiment, the press-fit pins 10 may also be temporarily fixed to the press-fit sheet 20 using, for example, glue or an adhesive tape. In this case, it is not necessarily required to finely adjust the aforementioned size relationship between the widened portion largest width dimension W1 and the through-hole diameter W2. For example, the press-fit pins 10 may be temporarily fixed to the upper surface 20*a* of the press-fit sheet 20 by an adhesive tape, or other methods may be employed.

Next, as illustrated in FIG. 7, a press-fit jig 40 is placed on the upper surface 20*a* of the press-fit sheet 20, and the press-fit jig 40 is pressed downward, i.e. toward the circuit board 100, using a press-fit device not illustrated. The press-fit jig 40 is provided with accommodation holes 41 to accommodate the connection pin portions 14 of the press-fit pins 10, respectively. By accommodating the connection pin portions 14 of the respective press-fit pins 10 within the accommodation holes 41, the pressing force of the press-fit device may be prevented from acting on the connection pin portions 14 of the respective press-fit pins 10. Accordingly, the connection pin portions 14 of the respective press-fit pins 10 may be suppressed from being bent or damaged.

Figure 8:
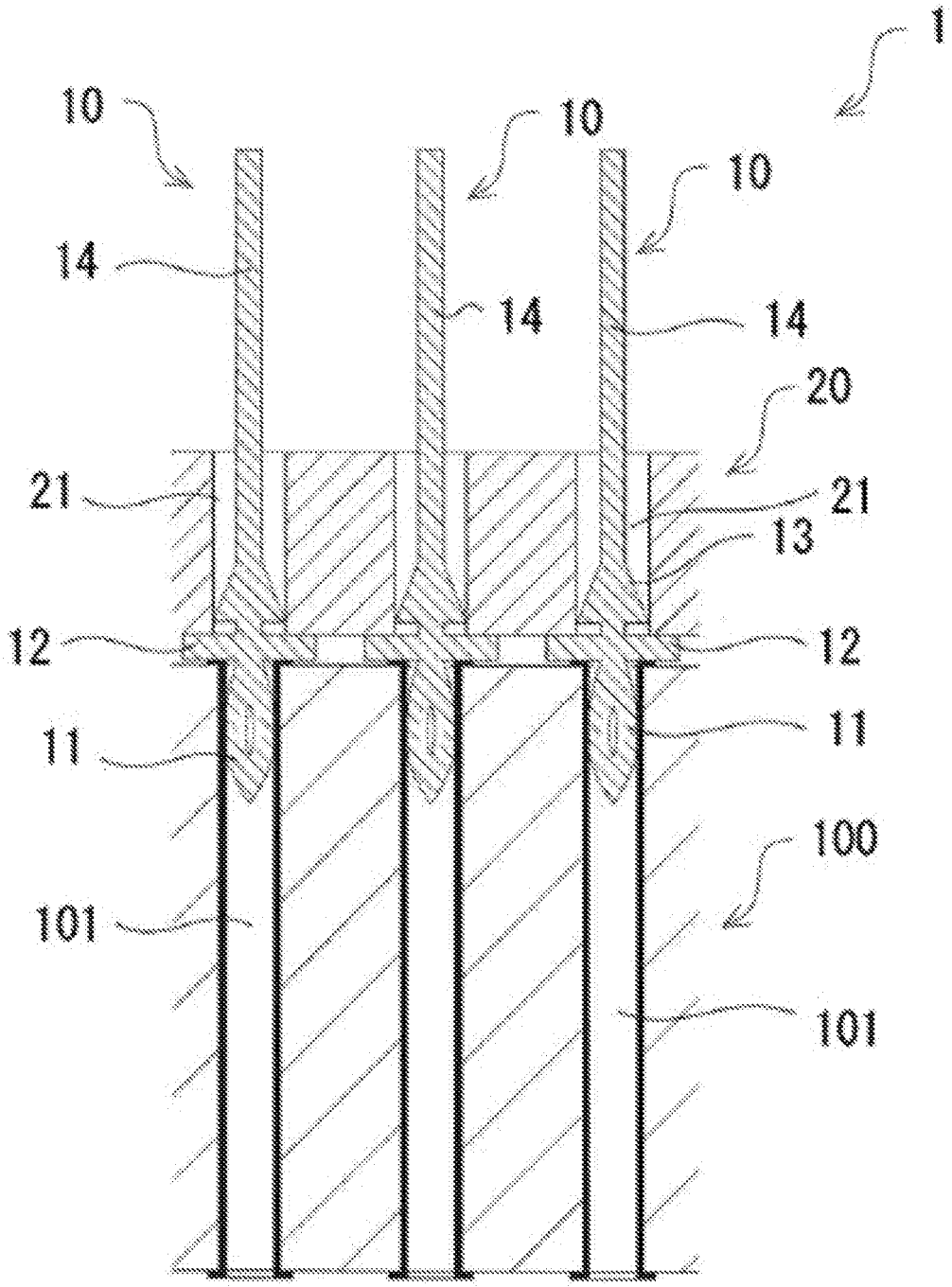
FIG. 8 is a view illustrating the press-fitting process of the press-fit pins according to Embodiment 1 (4)

FIG. 7 conceptually illustrates the sequential transfer of the pressing force from the press-fit device to the press-fit jig 40, the press-fit sheet 20, and the press-fit pins 10 by white arrows. The pressing force from the press-fit device is first transferred to the upper surface 20*a* of the press-fit sheet 20 via the press-fit jig 40. Here, the upper surfaces of the flange portions 12 of the press-fit pins 10 are positioned in a state of abutting against the lower surface 20*b* of the press-fit sheet 20. Thus, the pressing force transferred to the press-fit sheet 20 is transferred from the lower surface 20*b* of the press-fit sheet 20 to the flange portions 12 of the press-fit pins 10. That is, the flange portions 12 of the press-fit pins 10 are pressed by the lower surface 20*b* of the press-fit sheet 20, and as illustrated in FIG. 8, the press-fit portions 11 of the press-fit pins 10 are press-fitted into the through-holes 101 of the circuit board 100, respectively.

Furthermore, the press-fit portions 11 of the press-fit pins 10 have an outer diameter larger than the inner diameter of the through-holes 101 and are elastically deformable in a diameter reduction direction. Thus, the press-fit portions 11 of the press-fit pins 10 are press-fitted into the through-holes 101 while pressing the outer circumferential surfaces thereof against the inner wall surfaces of the through-holes 101. The press-fit portions 11 are inserted until the flange portions 12 of the press-fit pins 10 abut against the edge portions of the through-holes 101, respectively. FIG. 8 illustrates a state after the press-fit jig 40, which has been placed on the upper surface 20*a* of the press-fit sheet 20, is removed.

Figure 9:
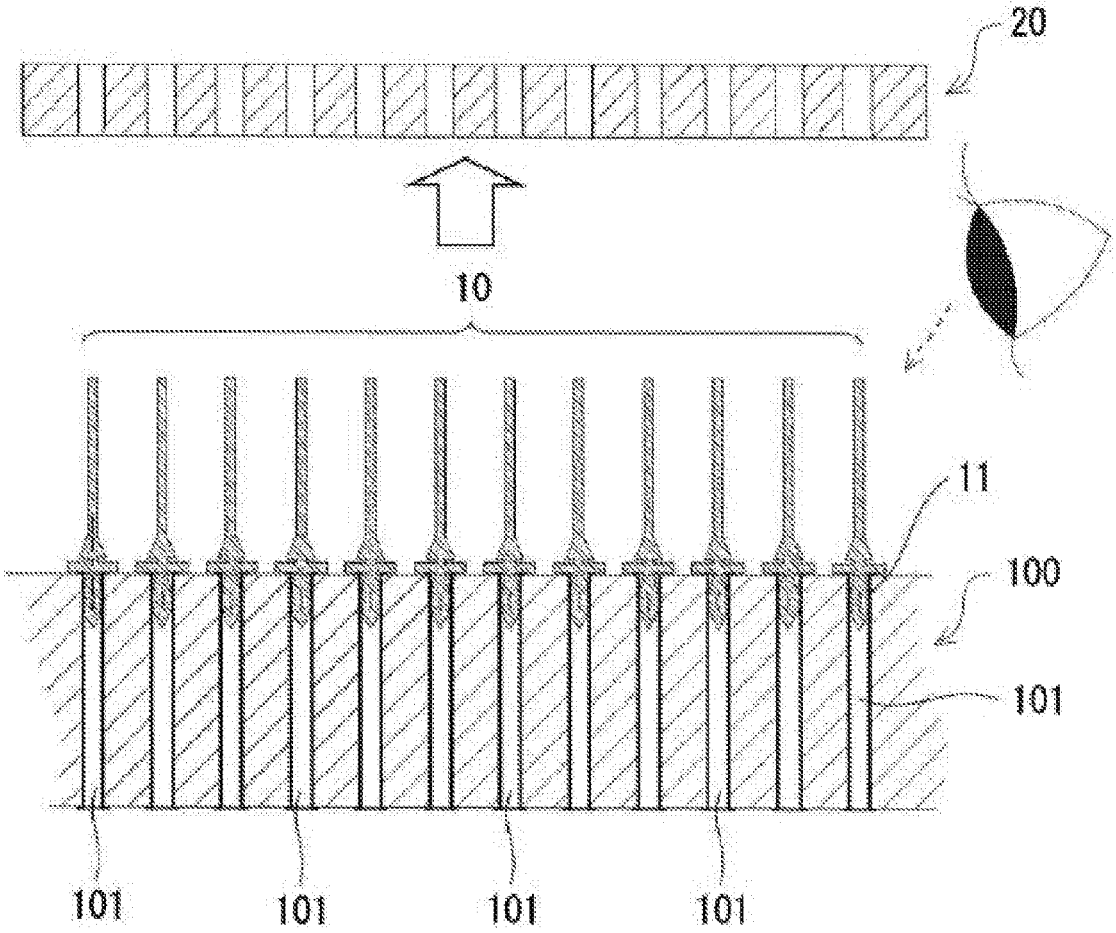
FIG. 9 is a view illustrating a state in which the press-fit sheet is removed from the press-fitted press-fit pins according to Embodiment 1.
Figure 10:
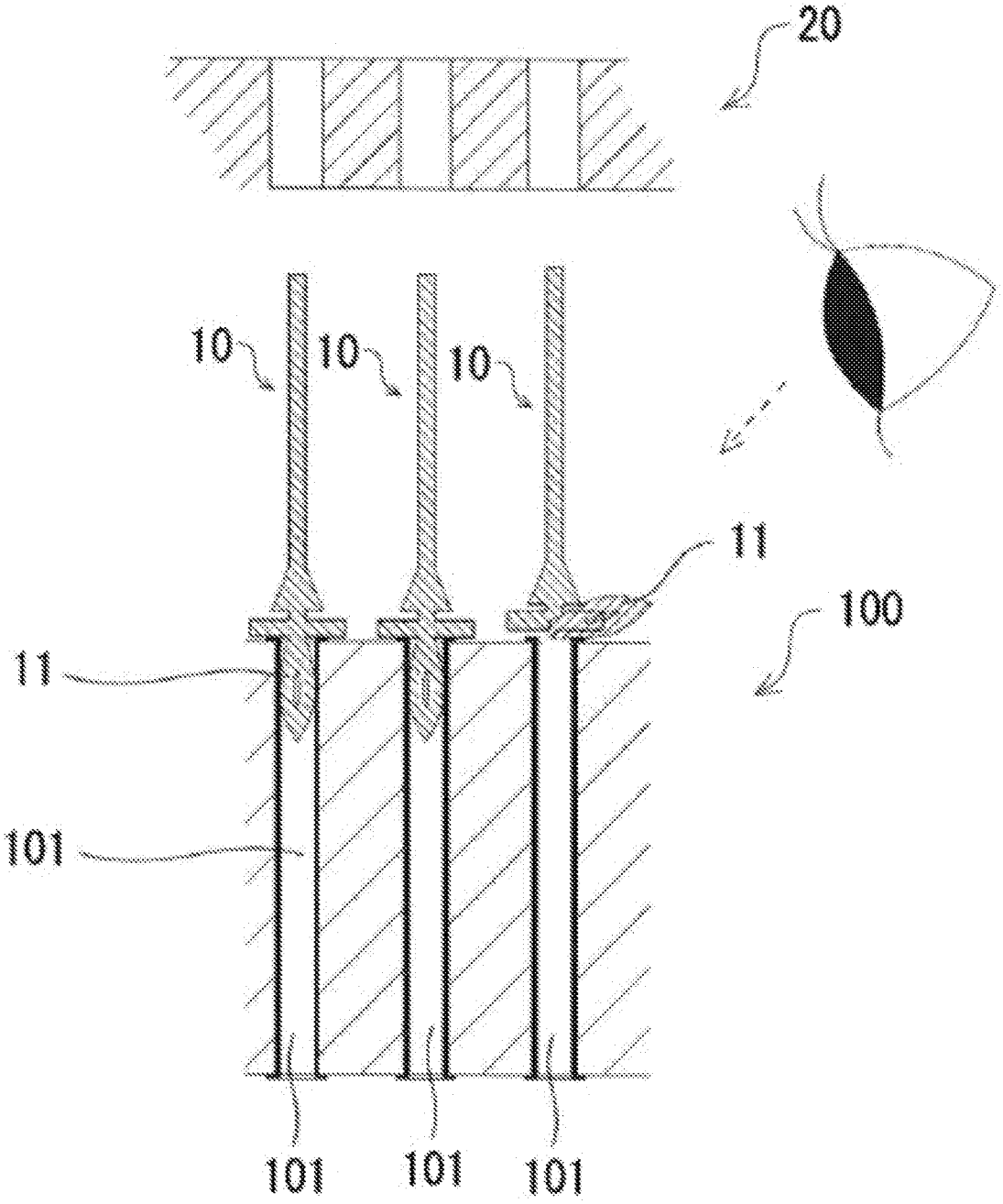
FIG. 10 is a view illustrating a case where buckling is generated in a press-fit portion 11 of the press-fit pin according to Embodiment 1.

Here, the press-fit sheet 20 according to the present embodiment is mounted so that the press-fit pins 10 may be inserted into or removed from the through-holes 21. Thus, as illustrated in FIG. 9, the press-fit sheet 20 is removed from the press-fit pins 10 which is in the state of being press-fitted into the through-holes 101 of the circuit board 100. As a result, the presence or absence of buckling in the press-fit portions 11 of the press-fit pins 10 may be directly confirmed by a visual observation. For example, FIG. 10 is a view illustrating a case where buckling is generated in the press-fit portion 11 of a press-fit pin 10. Even in this case, according to the present embodiment, the buckling generated in the press-fit portion 11 of a press-fit pin 10 may be easily found without overlooking it. When the press-fit sheet 20 is removed from the press-fit pins 10, the buckled press-fit pin 10 may be raised together with the press-fit sheet 20 or falls sideways on the circuit board 100. Such a press-fit pin 10 indicates that the press-fit portion 11 is not normally press-fitted into the through-hole 101, which enables the presence or absence of buckling of the press-fit pin 10 to be easily confirmed by a visual observation.

Furthermore, according to the present embodiment, since the press-fit sheet 20 is removable from the press-fitted film press-fit pins 10, the presence or absence of buckling in the press-fit pins 10 may be confirmed at a glance. Accordingly, the work of confirming the presence or absence of buckling in the press-fit pin 10 may be easily confirmed without requiring much labor.

Figure 11:
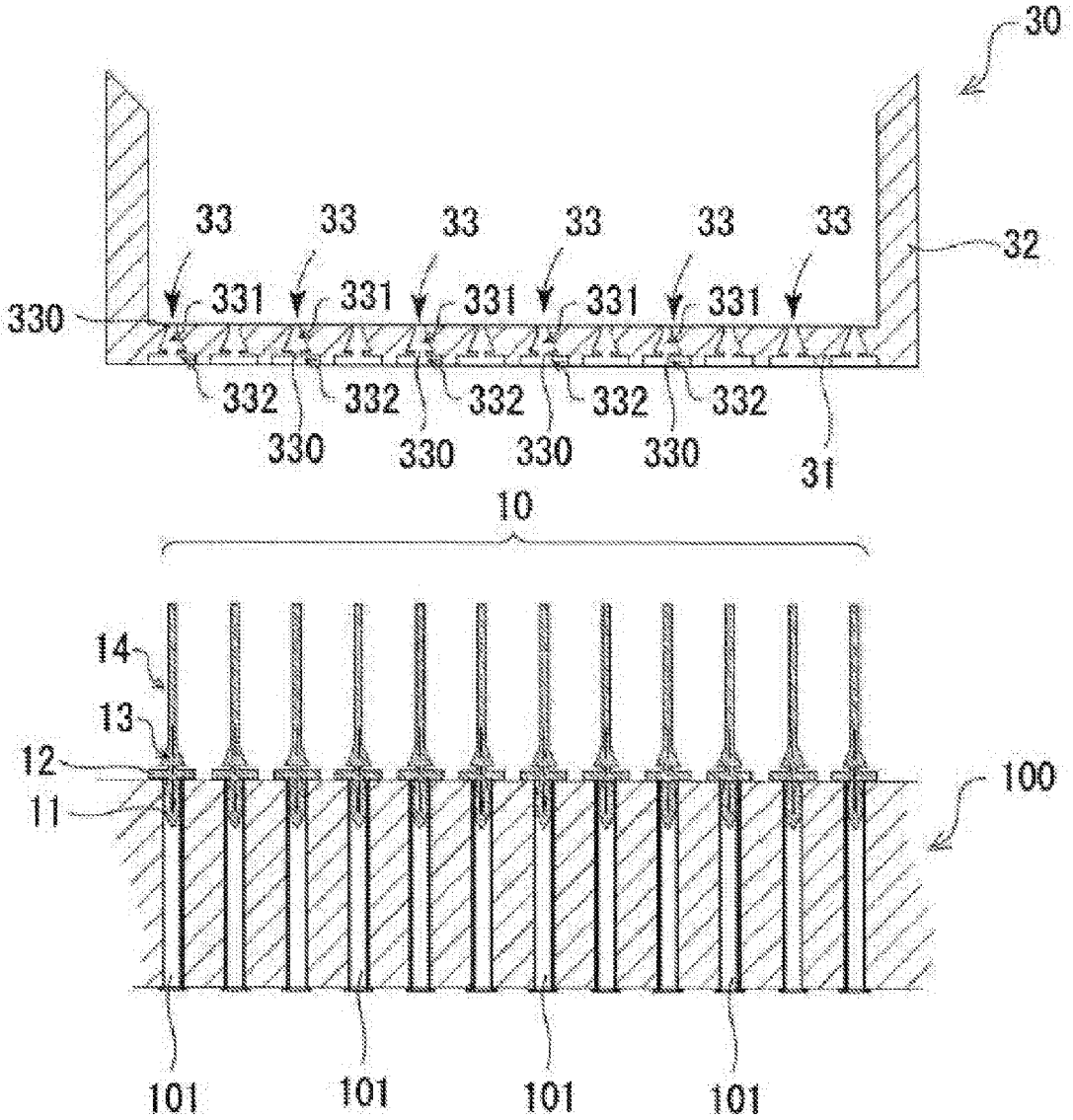
FIG. 11 is a view illustrating a housing according to Embodiment 1.

Next, in the present embodiment, a housing 30 illustrated in FIG. 11 is prepared and mounted to the press-fit pins 10 from which the press-fit sheet 20 has been removed. The housing 30 includes a bottom portion 31 and a sidewall portion 32 extending upward from the bottom portion 31. The bottom portion 31 of the housing 30 is provided with mounting holes 33, to which the press-fit pins 10 are mounted, respectively. Each of the mounting holes 33 of the housing 30 includes a pin insertion portion 330 that allows the connection pin portion 14 of the press-fit pin 10 to pass therethrough, a first accommodation portion 331 configured to accommodate the widened portion 13 of the press-fit pin 10, and a second accommodation portion 332 configured to accommodate the flange portion 12 of the press-fit pin 10. The pin insertion portion 330 is a cylindrical columnar space having a diameter slightly larger than the width of the connection pin portion 14 of the press-fit pin 10. Furthermore, the first accommodation portion 331 is a truncated conical space capable of accommodating the widened portion 13 of the press-fit pin 10. Moreover, the second accommodation portion 332 is a cylindrical columnar space capable of accommodating the flange portion 12 of the press-fit pin 10.

Figure 12:
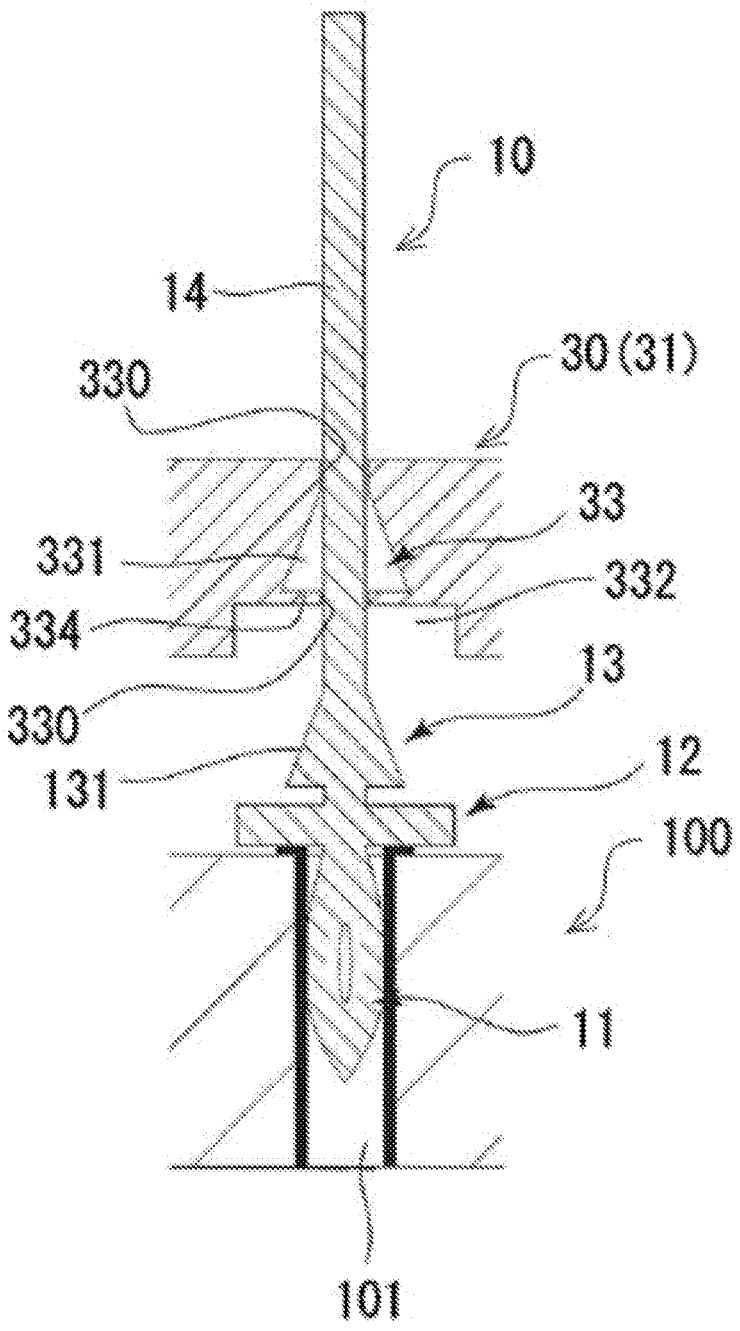
FIG. 12 is a view illustrating a process of mounting the housing to the press-fit pin according to Embodiment 1 (1)
Figure 13:
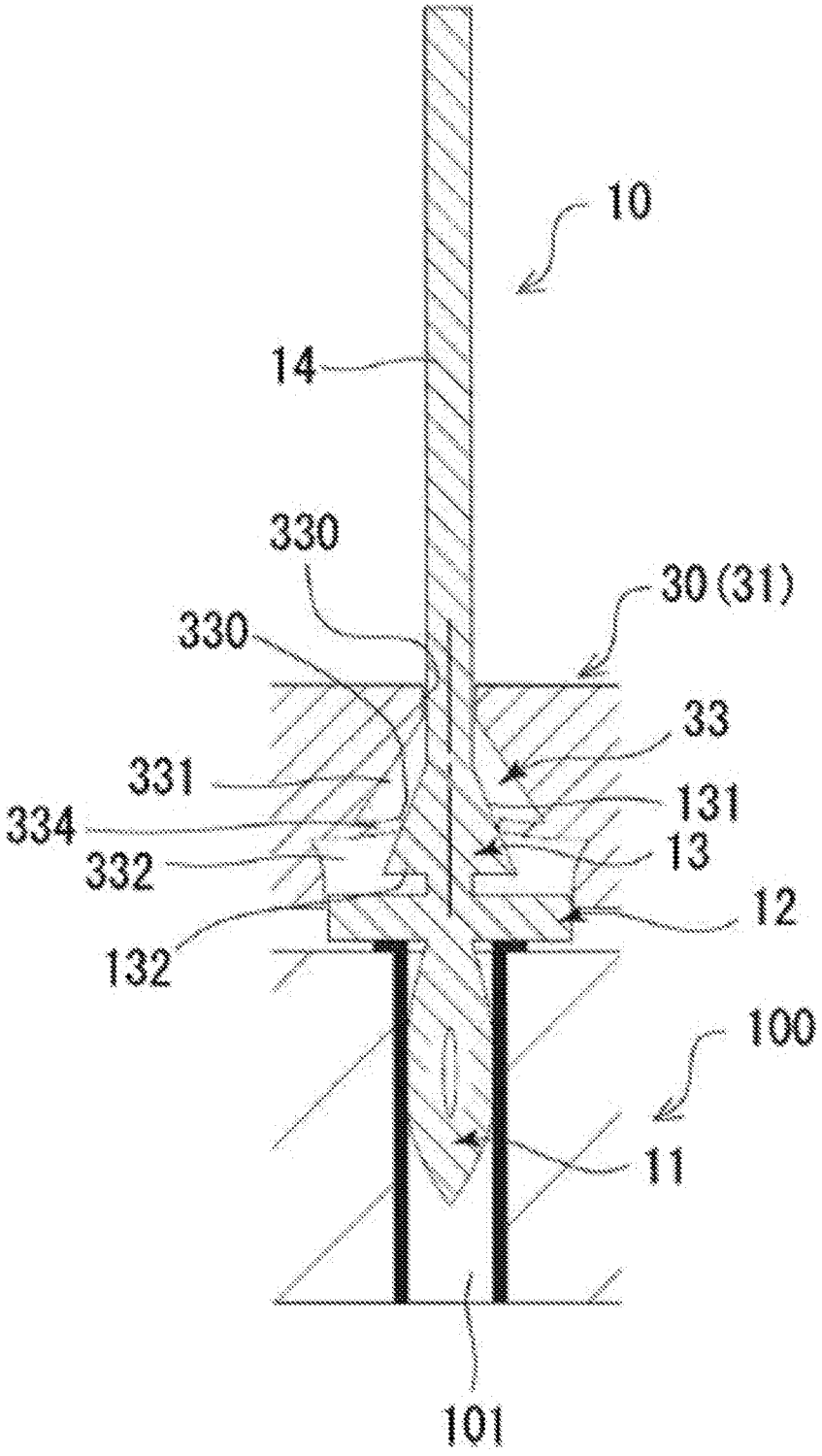
FIG. 13 is a view illustrating the process of mounting the housing to the press-fit pin according to Embodiment 1 (2)
Figure 14:
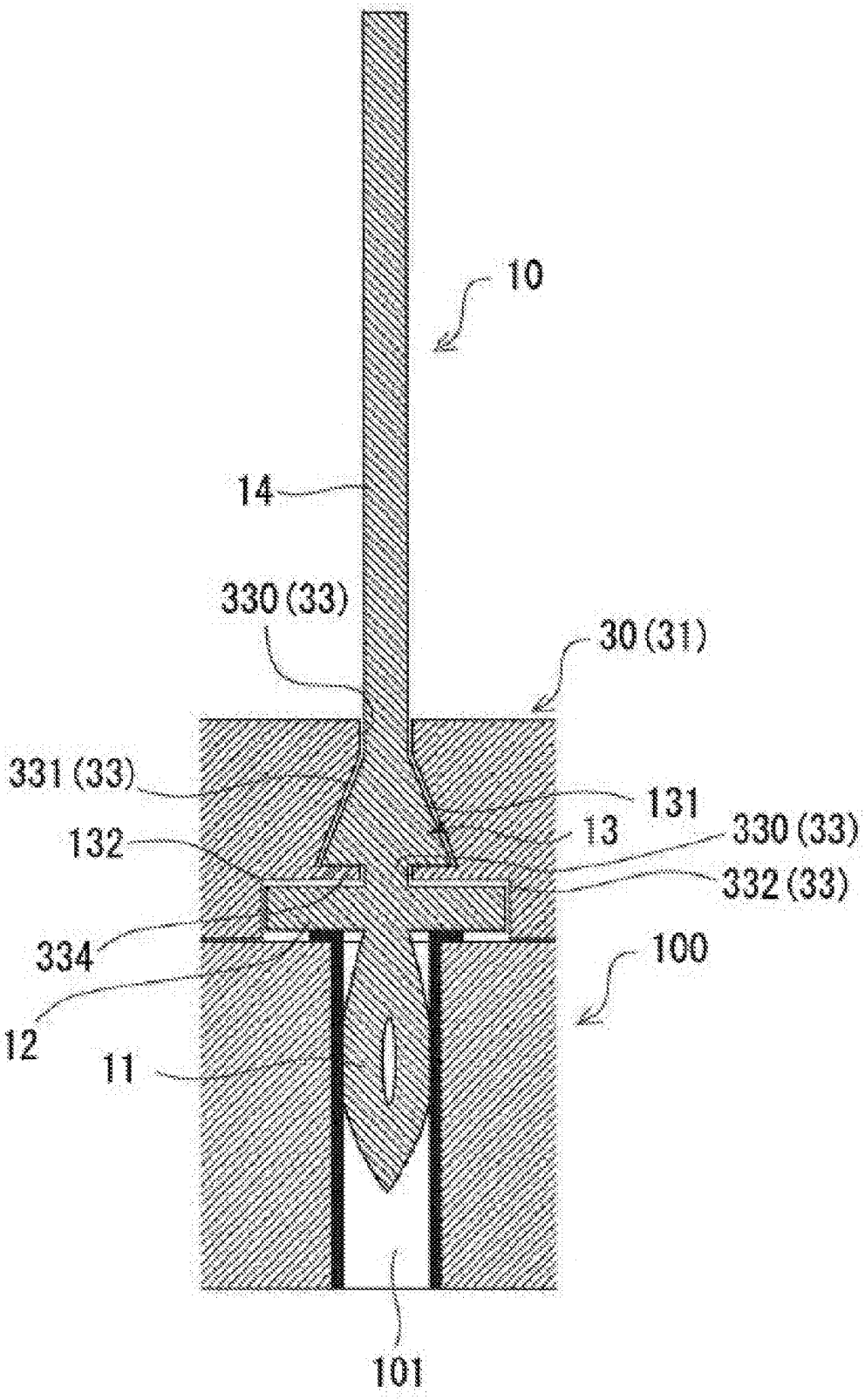
FIG. 14 is a view illustrating the process of mounting the housing to the press-fit pin according to Embodiment 1 (3)

FIGS. 12 to 14 are views illustrating a process of mounting the housing 30 to a press-fit pin 10. When mounting the housing 30 to the press-fit pin 10, the connection pin portion 14 of the press-fit pin 10 is inserted through one of the mounting holes 33 of the housing 30, as illustrated in FIG. 12. As the connection pin portion 14 is inserted through the mounting hole 33 of the housing 30, the widened portion 13 abut against an edge wall 334 of the pin insertion portion 330 existing between the first accommodation portion 331 and the second accommodation portion 332 of the mounting hole 33, thereby pressing the edge wall 334 of the pin insertion portion 330. As for the housing 30 according to the present embodiment, an elastic material such as, for example, a molded resin, is used. Thus, as illustrated in FIG. 13, the edge wall 334 of the housing 30 is elastically deformed by being pressed by the widened portion 13 (the tapered surface 131) of the press-fit pin 10 and the pin insertion portion 330 defined by the edge wall 334 is enlarged. Consequently, the widened portion 13 of the press-fit pin 10 enters into the first accommodation portion 331 of the housing 30, and at the time point when the entirety of the widened portion 13 is accommodated within the first accommodation portion 331, the mounting of the housing 30 to the press-fit pin 10 is completed. At this time point, the locking surface 132 of the widened portion 13 of the press-fit pin 10 locks the bottom surface of the first accommodation portion 331 of the housing 30, i.e. the edge wall 334. This may make it difficult for the housing 30 to be inadvertently released from the press-fit pin 10.

Furthermore, in the present embodiment, since the widened portion 13 of the press-fit pin 10 has the tapered surface 131, the pin insertion portion 330 may be easily enlarged and the housing 30 may be easily mounted. The mounting of the housing 30 to the press-fit pin 10 may be performed by a manual work, or may be performed using a machine. By mounting the housing 30 to the press-fit pin 10 as described above, the connector 1 illustrated in FIG. 4 is completed.

As described above, the connector 1 includes the press-fit pins 10, the press-fit sheet 20 configured to press-fit the removably-held press-fit pins 10 into the through-holes 101, and the housing 30 configured to be mounted to the press-fit pins 10 from which the press-fit sheet 20 has been removed. According to this connector 1, after the press-fit pins 10 are press-fitted to the through-holes 101, the presence or absence of buckling in the press-fit portions 11 of the press-fit pins 10 may be easily confirmed by a visual observation.

Furthermore, the press-fit portion 11 according to the present embodiment includes the flange portion 12 configured to receive a pressing force from the edge portion of the through-hole 21 of the press-fit sheet 20 when the press-fit portion 11 is press-fitted into the through-hole 101. This enables the press-fit portion 11 of the press-fit pin 10 to be easily press-fitted into the through-hole 101 of the circuit board 100. Moreover, in the present embodiment, the flange portion 12 of the press-fit pin 10 is an exemplary pressed portion, and the edge portion of the through-hole 21, which transfers a pressing force to the flange portion 12, is an exemplary pressing portion.

Figure 15:
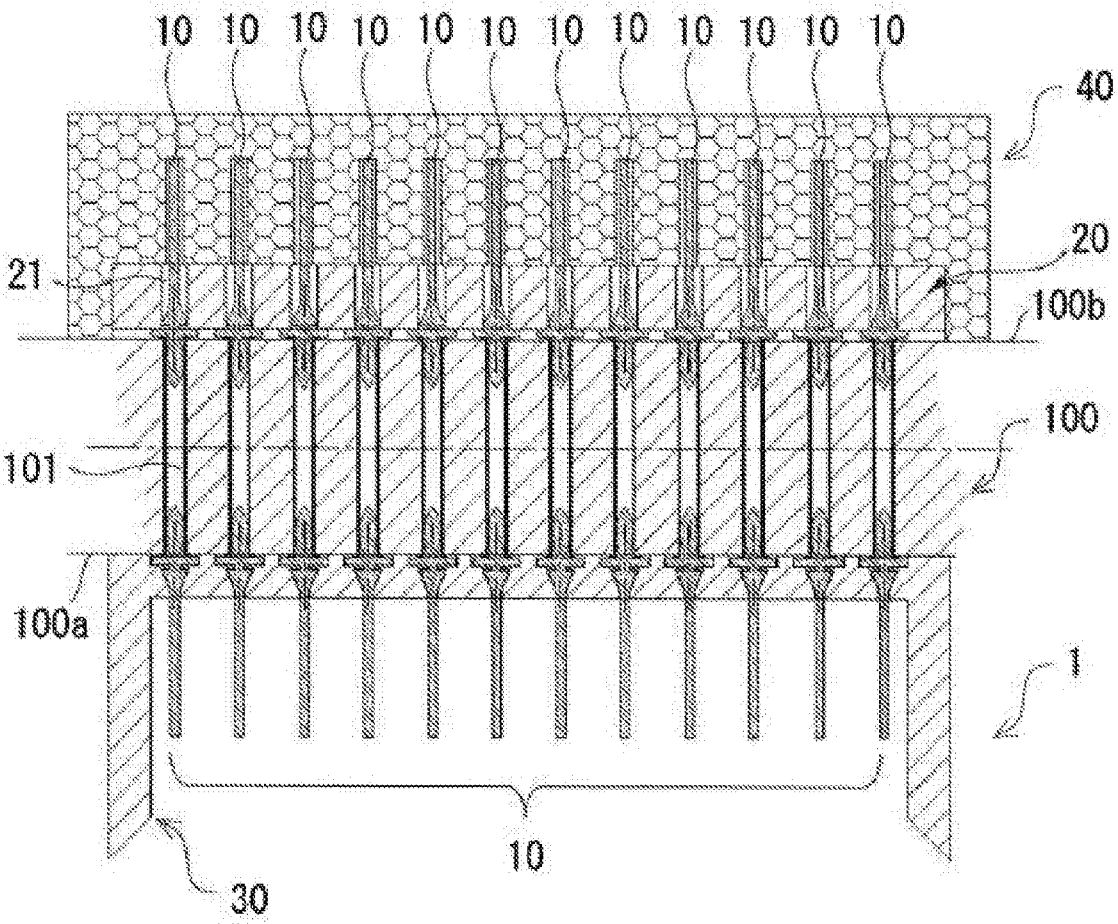
FIG. 15 is a view illustrating a state in which connectors are implanted on both sides of a circuit board according to Embodiment 1 (1)
Figure 16:
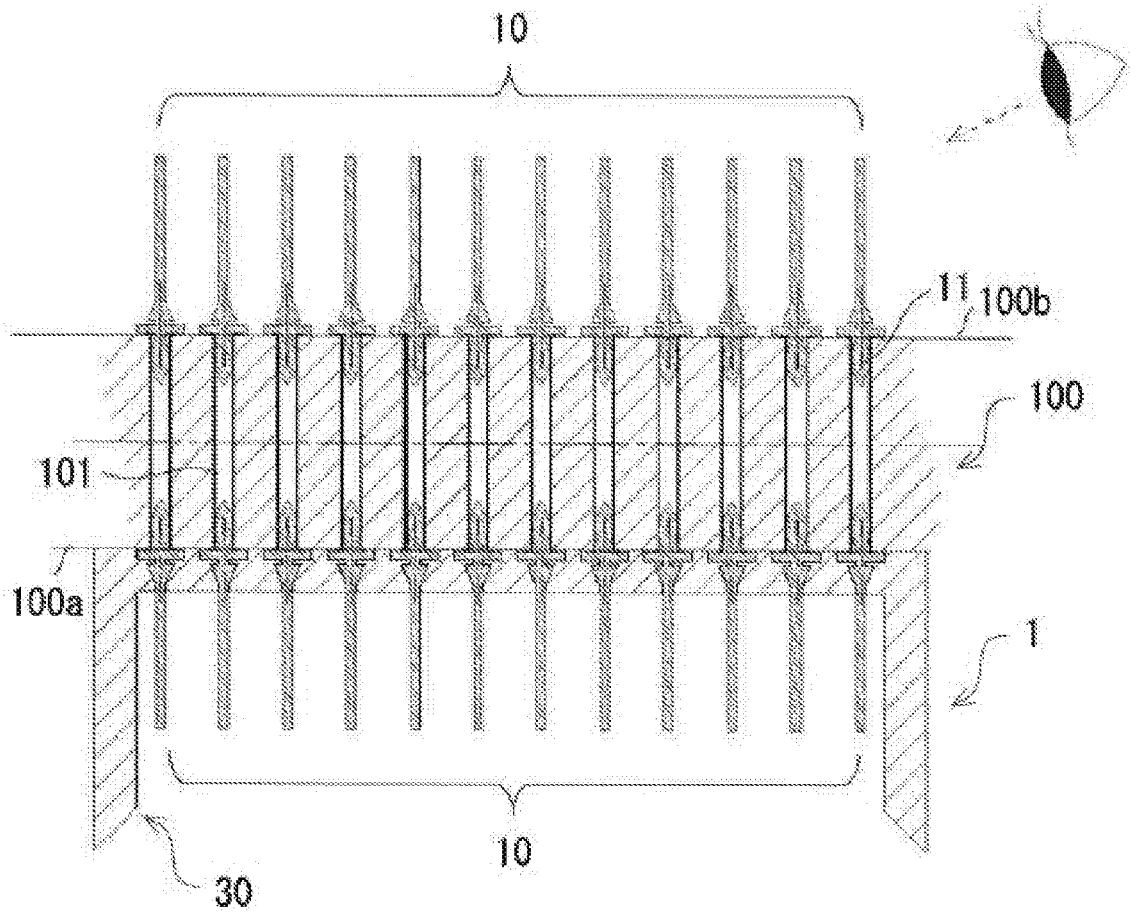
FIG. 16 is a view illustrating the state in which the connectors are implanted on both sides of the circuit board according to Embodiment 1 (2)
Figure 17:
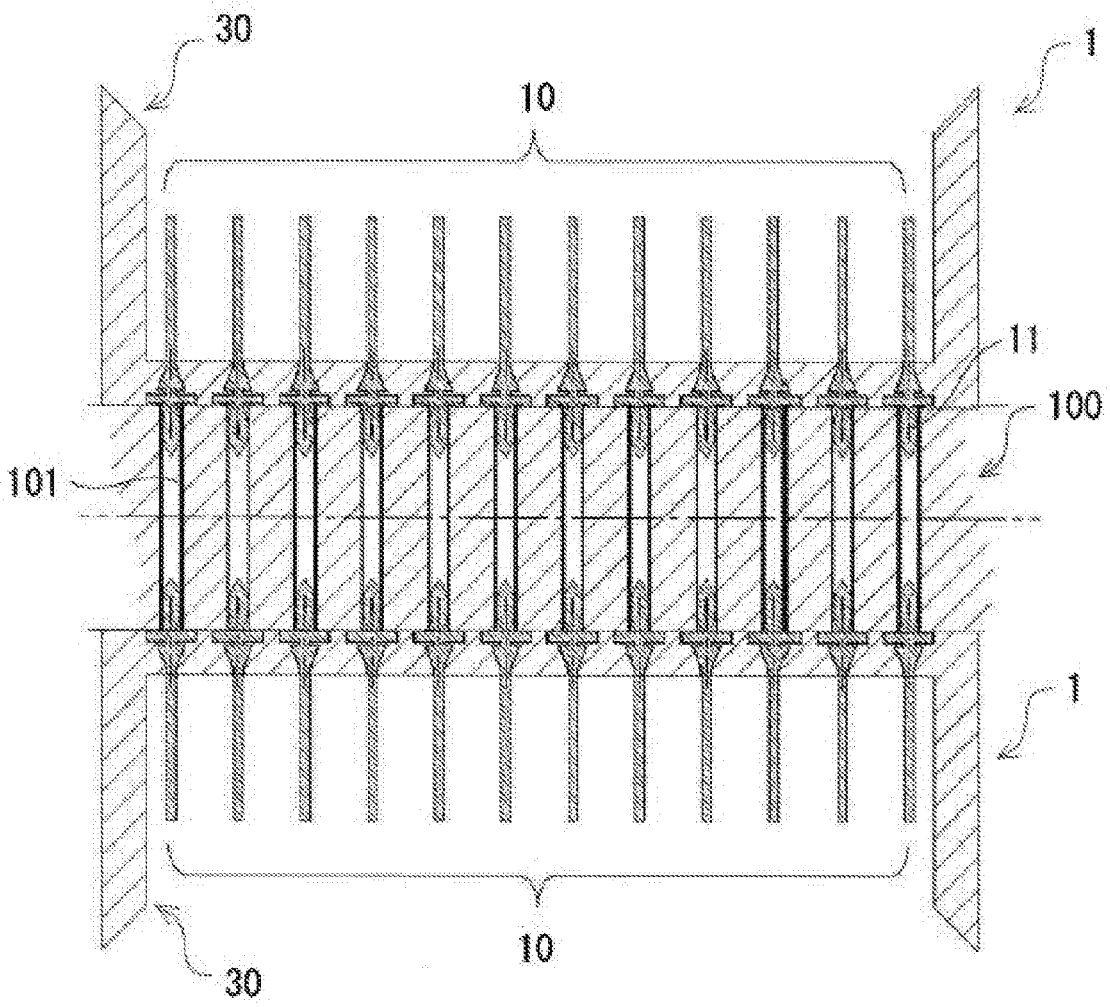
FIG. 17 is a view illustrating the state in which the connectors are implanted on both sides of the circuit board according to Embodiment 1 (3)

Furthermore, the connectors 1 according to the present embodiment may be driven into opposite sides of the circuit board 100. FIGS. 15 to 17 are views illustrating a state in which the connectors 1 are driven into opposite sides of the circuit board 100 according to Embodiment 1. In the example illustrated in FIGS. 15 to 17, the press-fit pins 10 are press-fitted from the opposite sides of the through-holes 101 of the circuit board 100. In FIG. 15, after the connector 1 is driven into the upper surface 100*a* of the circuit board 100 (see, e.g., FIG. 4), the circuit board 100 is reversed and the press-fit pins 10 are press-fitted into the through-holes 101 from the lower surface 100*b* side of the circuit board 100 through the press-fit sheet 20. The press-fitting of the press-fit pins 10 using the press-fit sheet 20 is performed in the same manner as described with reference to FIGS. 7 and 8. Descriptions thereof will be omitted here.

Then, as illustrated in FIG. 16, the press-fit sheet 20 is removed from the press-fit pins 10 press-fitted into the through-holes 101 of the circuit board 100, the presence or absence of buckling in the press-fit portions 11 of the press-fit pins 10 is confirmed by a visual observation. Then, as illustrated in FIG. 17, the connector 1 attached to the side of the lower surface 100*b* of the circuit board 100 is completed by mounting the housing 30 to the press-fit pins 10. As described above, the connectors 1 may be driven into opposite sides of the circuit board 100.

<Embodiment 2>

Figure 18:
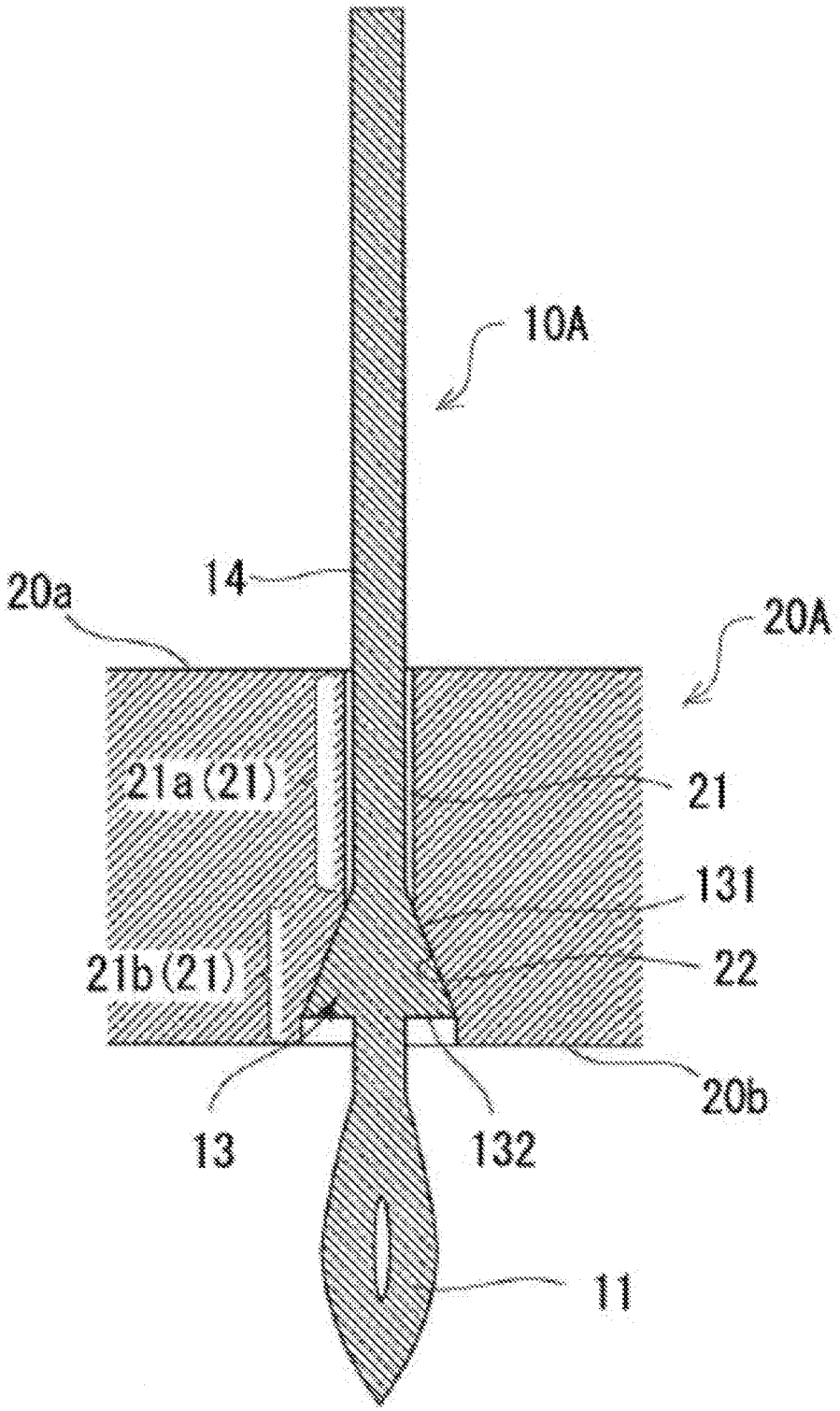
FIG. 18 is a view illustrating a press-fit pin and a press-fit sheet of a connector according to Embodiment 2.
Figure 19:
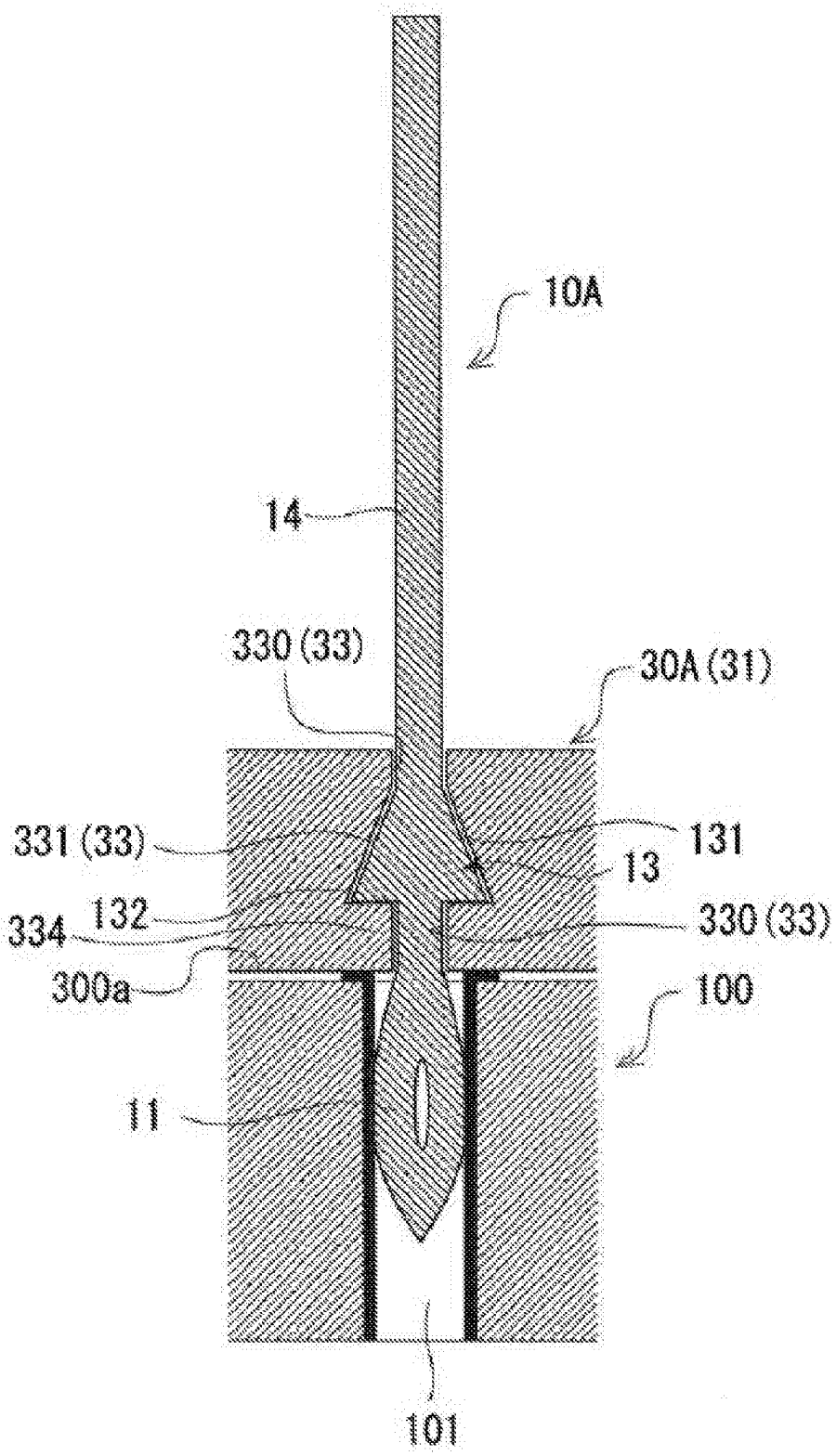
FIG. 19 is a view illustrating a press-fit pin and a housing of the connector according to Embodiment 2.

Next, Embodiment 2 will be described. A connector 1 according to Embodiment 2 includes a press-fit pin 10A, a press-fit sheet 20A, and a housing 30A. Hereinafter, descriptions will be made focusing on the features that are different from the press-fit pin 10, the press-fit sheet 20, and the housing 30 according to Embodiment 1. FIG. 18 is a view illustrating the press-fit pin 10A and the press-fit sheet 20A of the connector 1 according to Embodiment 2. FIG. 19 is a view illustrating the press-fit pin 10A and the housing 30A of the connector 1 according to Embodiment 2.

The press-fit pin 10A according to Embodiment 2 is different from the press-fit pin 10 according to Embodiment 1 in that the press-fit pin 10A does not include the flange portion 12. Furthermore, in the press-fit sheet 20 according to the present embodiment, the cross-sectional shape of the through-hole 21 varies along the thickness direction of the press-fit sheet 20A. Reference symbol 21*a* designates a "first hole portion" which is a cylindrical columnar space having a diameter slightly larger than the width of connection pin portion 14. Reference symbol 21*b* designates a "second hole portion" which is a space having a diameter larger than the diameter of the first hole portion 21*a*. The second hole portion 21*b* has a shape obtained by combining a truncated cone and a cylindrical column. The second hole portion 21*b* includes a tapered pressing surface 22 formed in a portion thereof. The tapered pressing surface 22 is a portion of the inner wall surface of the through-hole 21. As illustrated in FIG. 18, the tapered pressing surface 22 is disposed so as to face the tapered surface 131 of the widened portion 13 in a state in which the press-fit pin 10A is held in the press-fit sheet 20A.

Furthermore, in the present embodiment, the widened portion largest width dimension of the widened portion 13 of the press-fit pin 10A is set to a dimension slightly larger than the largest diameter of the second hole portion 21*b* of the press-fit sheet 20A. Thus, when the press-fit pin 10A is inserted into the through-hole 21 of the press-fit sheet 20A, the press-fit pin 10A is capable of being held on the press-fit sheet 20A without being dropped by its own weight. Similar to Embodiment 1, the press-fit pin 10A may be temporarily fixed to the press-fit sheet 20A by glue or an adhesive tape.

In the present embodiment, when the press-fit pin 10A is press-fitted into the through-hole 101 of the circuit board 100, the pressing force transferred via the press-fit jig 40 is transferred from the tapered pressing surface 22 of the press-fit sheet 20A to the tapered surface 131 of the widened portion 13. That is, since the tapered surface 131 of the press-fit pin 10A is pressed by the tapered pressing surface 22 of the press-fit sheet 20A, the press-fit portion 11 of the press-fit pin 10A is press-fitted into the through-hole 101. In the present embodiment, the tapered surface 131 of the widened portion 13 is an exemplary pressed portion, and the tapered pressing surface 22 of the press-fit sheet 20A is an exemplary pressing portion. Even in the present embodiment, the presence or absence of buckling in the press-fit pin 10A may be easily confirmed by a visual observation by removing the press-fit sheet 20A from the press-fit pin 10A after the press-fit pin 10A is press-fitted.

Next, the housing 30A according to the present embodiment will be described with reference to FIG. 19. The housing 30A is different from the housing 30 according to Embodiment 1 in terms of the shape of the mounting hole 33. As described above, since the press-fit pin 10A according to the present embodiment does not include the flange portion 12, the housing 30A does not include the aforementioned second accommodation portion 332. That is, the mounting hole 33 of the housing 30A includes a pin insertion portion 330 configured to accommodate the connection pin portion 14 of the press-fit pin 10A and a first accommodation portion 331 configured to accommodate the widened portion 13. The pin insertion portion 330 is a cylindrical columnar hole portion capable of accommodating the connection pin portion 14 of the press-fit pin 10A. Furthermore, the first accommodation portion 331 is a truncated conical hole portion capable of accommodating the widened portion 13 of the press-fit pin 10A.

Even in the present embodiment, the housing 30A is mounted to the press-fit pin 10A from which the press-fit sheet 20A has been removed. That is, the press-fit pin 10A is mounted to the mounting hole 33 of the housing 30A while pressing and elastically deforming the edge wall 334 of the pin insertion portion 330, which is positioned at the lower surface 300*a* side of the housing 30A, by the widened portion 13 (the tapered surface 131). Then, the tapered surface 131 of the widened portion 13 of the press-fit pin 10A moves over the edge wall 334, and the locking surface 132 of the widened portion 13 locks the edge wall 334 of the housing 30A. Thus, the housing 30A is suppressed from being inadvertently released from the press-fit pin 10A. Furthermore, in the present embodiment, since the widened portion 13 of the press-fit pin 10A includes the tapered surface 131 inclined with respect to the axial direction of the press-fit pin 10A, the housing 30A may be easily mounted to the press-fit pin 10A.

<Embodiment 3>

Figure 20:
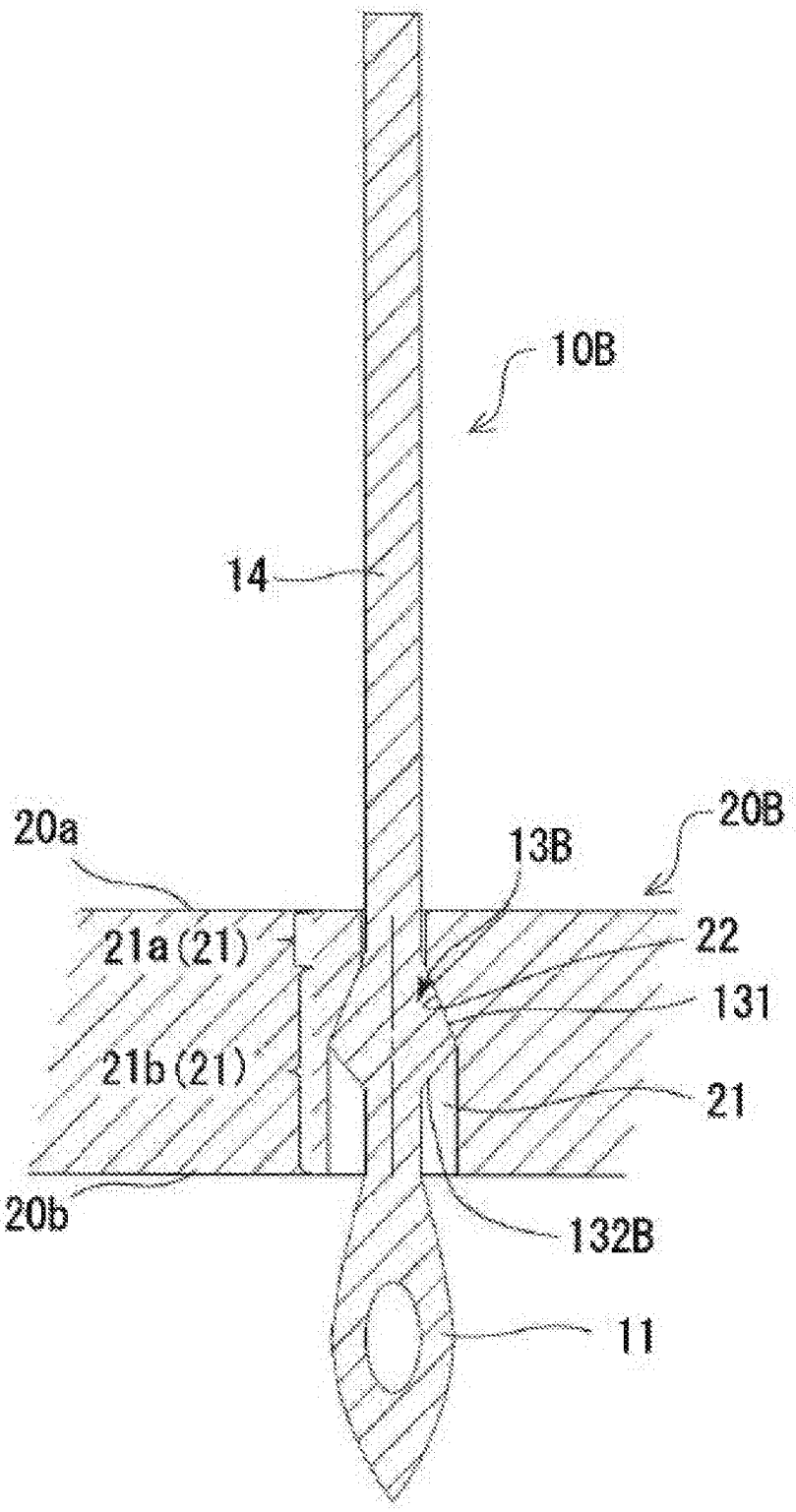
FIG. 20 is a view illustrating a press-fit pin and a press-fit sheet of a connector according to Embodiment 3.
Figure 21:
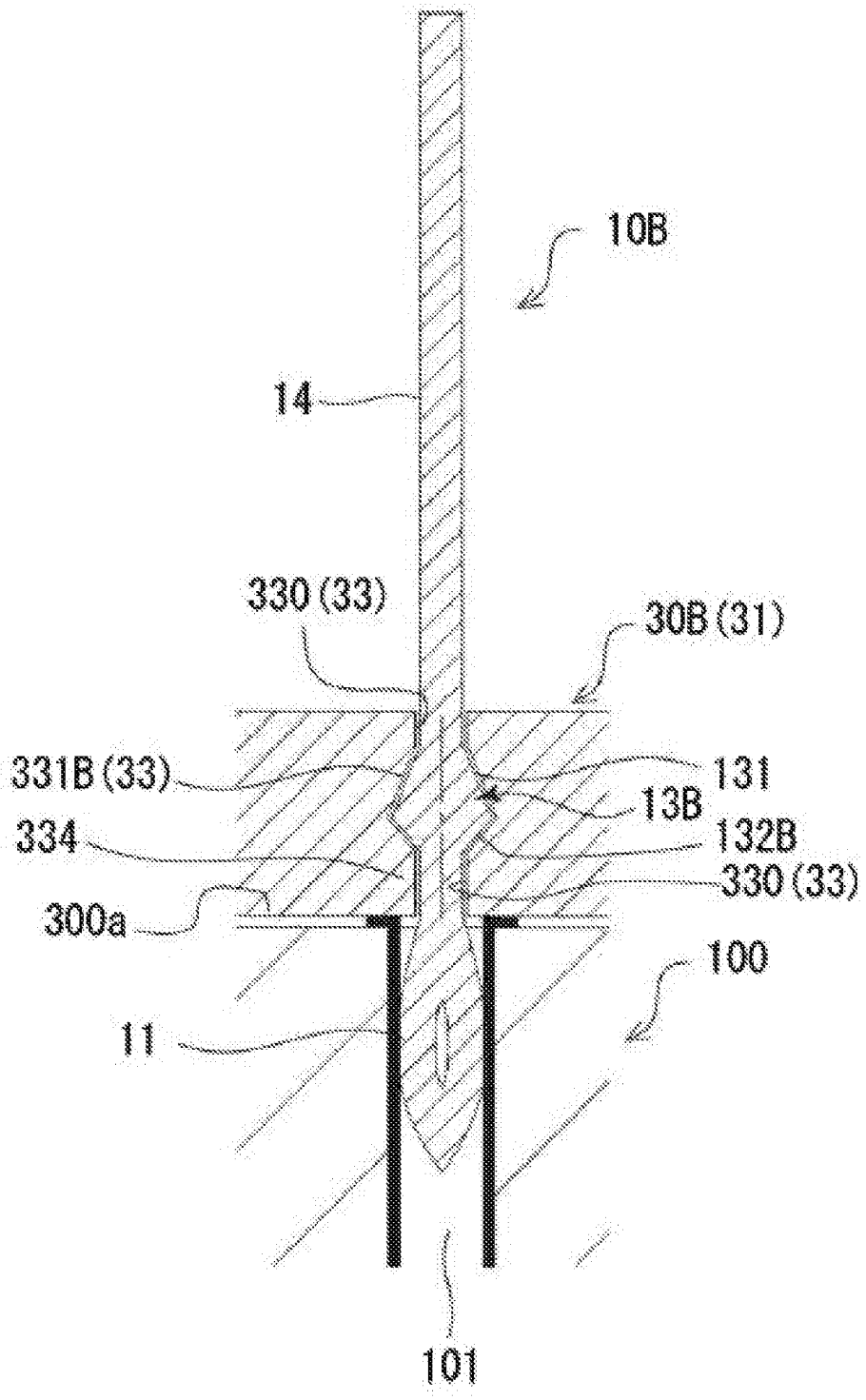
FIG. 21 is a view illustrating a press-fit pin and a housing of the connector according to Embodiment 3.

Next, Embodiment 3 will be described. A connector 1 according to Embodiment 3 includes a press-fit pin 10B, a press-fit sheet 20B, and a housing 30B. Hereinafter, descriptions will be made focusing on the features that are different from the press-fit pin 10A, the press-fit sheet 20A, and the housing 30A according to Embodiment 2. FIG. 20 is a view illustrating the press-fit pin 10B and the press-fit sheet 20B of the connector 1 according to Embodiment 3. FIG. 21 is a view illustrating the press-fit pin 10B and the housing 30B of the connector 1 according to Embodiment 3.

The shape of the widened portion 13B of the press-fit pin 10B is different from the shape of the widened portion 13 of the press-fit pin 10A according to Embodiment 2. Specifically, in the widened portion 13B of the press-fit pin 10B, a tapered locking surface 132B is connected to the lower end of the tapered surface 131. The tapered locking surface 132B is a tapered surface whose width dimension is largest at the end connected to the tapered surface 131 and is gradually reduced away from the tapered surface 131.

Similar to the press-fit sheet 20A, the through-hole 21 of the press-fit sheet 20B includes a first hole portion 21*a* and a second hole portion 21*b*. Furthermore, the second hole portion 21*b* is provided with a tapered pressing surface 22 that is disposed to face the tapered surface 131 of the widened portion 13B in a state in which the press-fit pin 10B is held in the press-fit sheet 20B.

Furthermore, in the present embodiment, the widened portion largest width dimension of the widened portion 13B of the press-fit pin 10B is set to a dimension slightly larger than the largest diameter of the second hole portion 21*b* of the press-fit sheet 20B. Thus, when the press-fit pin 10B is inserted into the through-hole 21 of the press-fit sheet 20B, the press-fit pin 10B is capable of being held on the press-fit sheet 20B without being dropped by its own weight. Similar to the aforementioned embodiments, the press-fit pin 10B may be temporarily fixed to the press-fit sheet 20B by glue or an adhesive tape.

In the present embodiment, when the press-fit pin 10B is press-fitted into the through-hole 101 of the circuit board 100, the pressing force transferred via the press-fit jig 40 is transferred from the tapered pressing surface 22 of the press-fit sheet 20B to the tapered surface 131 of the widened portion 13B. That is, since the tapered surface 131 of the press-fit pin 10B is pressed by the tapered pressing surface 22 of the press-fit sheet 20B, the press-fit portion 11 of the press-fit pin 10B is press-fitted into the through-hole 101. In the present embodiment, the tapered surface 131 of the widened portion 13B is an exemplary pressed portion, and the tapered pressing surface 22 of the press-fit sheet 20B is an exemplary pressing portion. Even in the present embodiment, the presence or absence of buckling in the press-fit pin 10B may be easily confirmed by a visual observation by removing the press-fit sheet 20B from the press-fit pin 10B after the press-fit pin 10B is press-fitted.

Next, the housing 30B according to the present embodiment will be described with reference to FIG. 21. The housing 30B is different from the housing 30A according to Embodiment 2 in terms of the shape of the mounting hole 33. Specifically, the housing 30B includes a pin insertion portion 330 configured to accommodate the connection pin portion 14 of the press-fit pin 10B and a first accommodation portion 331B configured to accommodate the widened portion 13B. The first accommodation portion 331B of the housing 30B has a shape obtained by combining two truncated cones.

Even in the present embodiment, the housing 30B is mounted to the press-fit pin 10B from which the press-fit sheet 20B has been removed. That is, the press-fit pin 10B is mounted to the mounting hole 33 of the housing 30B while pressing and elastically deforming the edge wall 334 of the pin insertion portion 330, which is positioned at the side of a lower surface 300*a* of the housing 30B, by the widened portion 13B (the tapered surface 131). Then, the tapered surface 131 of the widened portion 13B of the press-fit pin 10B moves over the edge wall 334, and the tapered locking surface 132B of the widened portion 13B locks the edge wall 334 of the housing 30B. Thus, the housing 30B is suppressed from being inadvertently released from the press-fit pin 10B. Furthermore, in the present embodiment, since the widened portion 13B of the press-fit pin 10B includes the tapered surface 131 inclined with respect to the axial direction of the press-fit pin 10B, the housing 30B may be easily mounted to the press-fit pin 10B.

<Embodiment 4>

Figure 22:
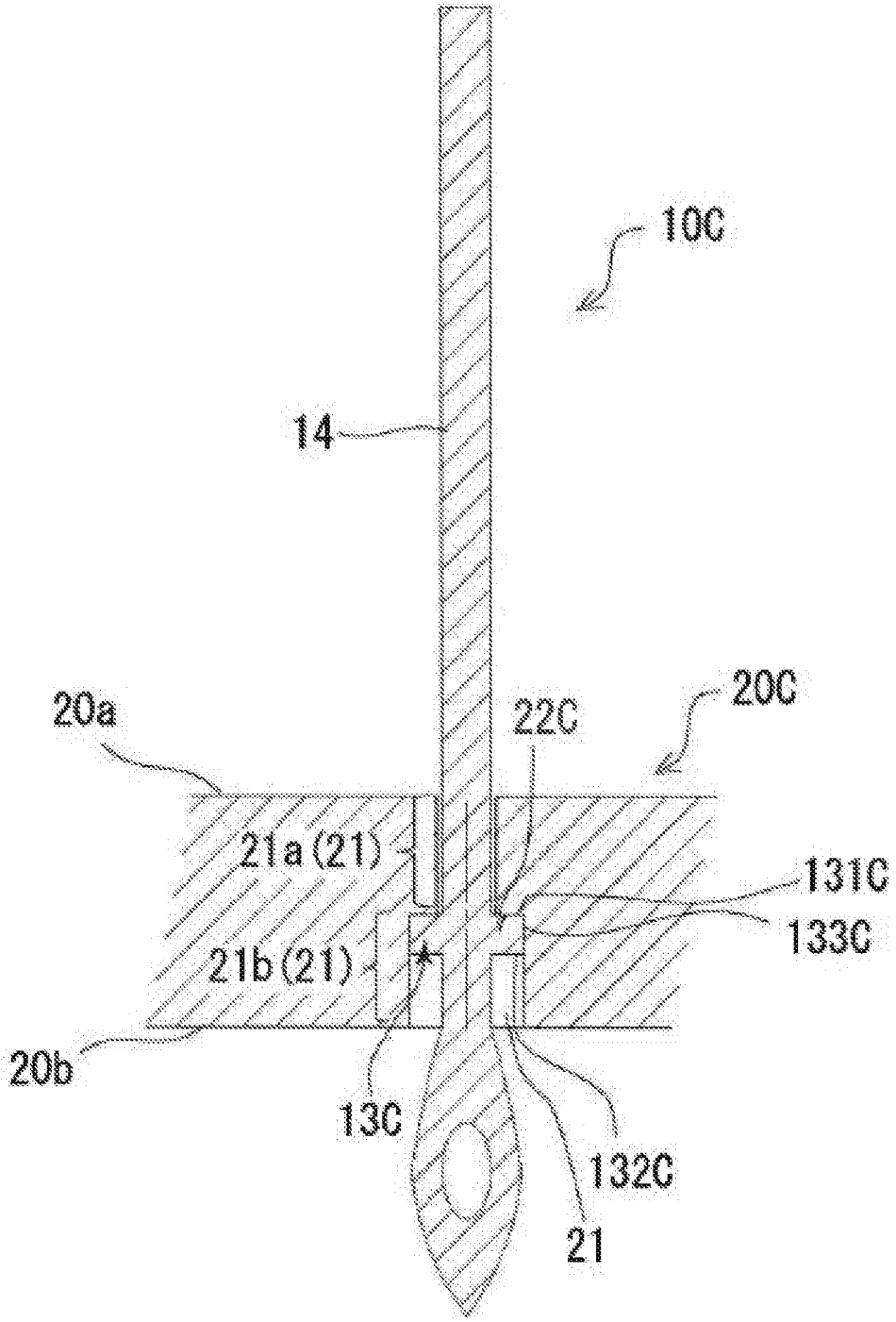
FIG. 22 is a view illustrating a press-fit pin and a press-fit sheet of a connector according to Embodiment 4.
Figure 23:
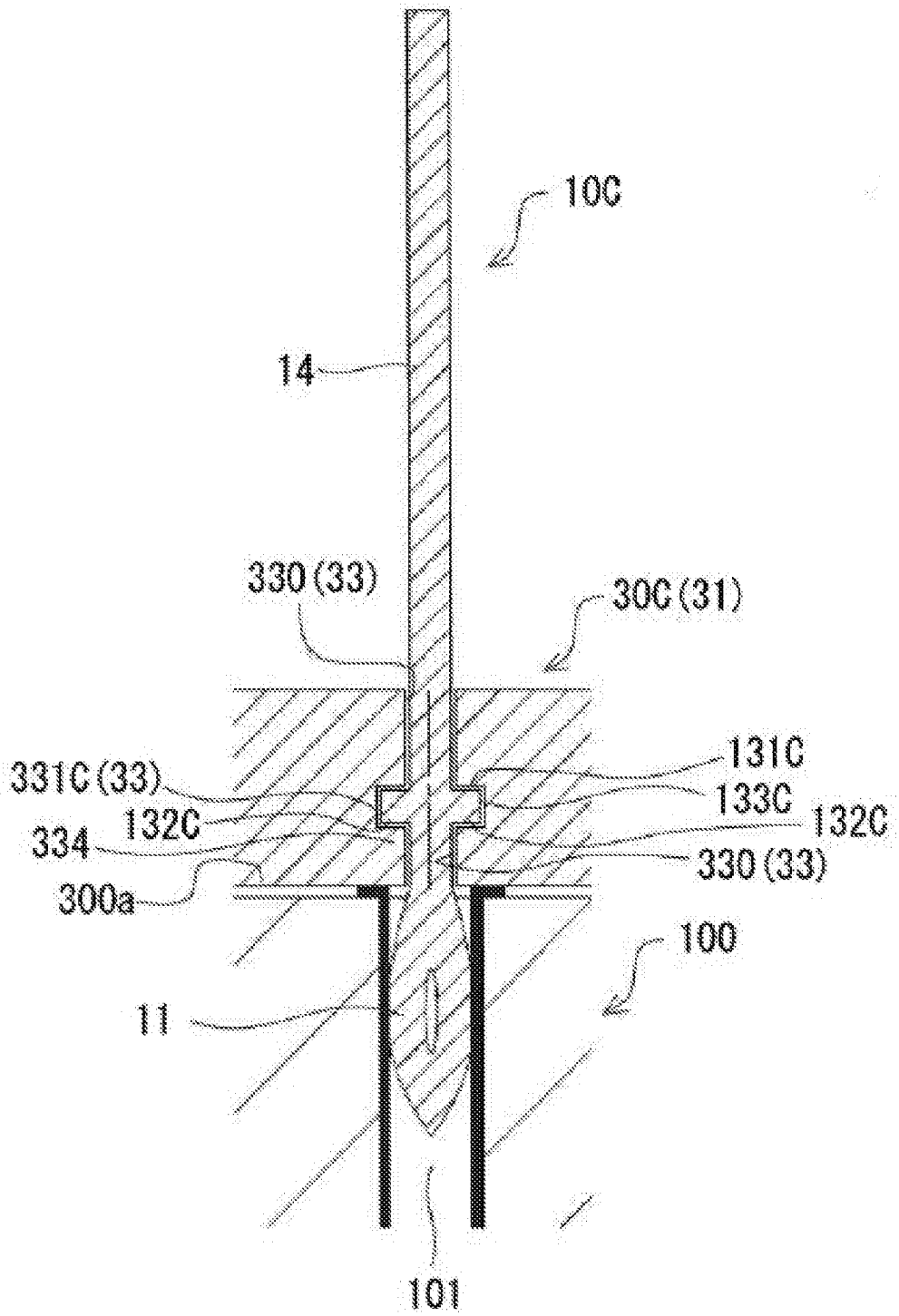
FIG. 23 is a view illustrating a press-fit pin and a housing of the connector according to Embodiment 4.

Next, Embodiment 4 will be described. A connector 1 according to Embodiment 4 includes a press-fit pin 10C, a press-fit sheet 20C, and a housing 30C. Hereinafter, descriptions will be made focusing on the features that are different from the press-fit pin 10B, the press-fit sheet 20B, and the housing 30B according to Embodiment 3. FIG. 22 is a view illustrating the press-fit pin 10C and the press-fit sheet 20C of the connector 1 according to Embodiment 4. FIG. 23 is a view illustrating the press-fit pin 10C and the housing 30C of the connector 1 according to Embodiment 4.

The press-fit pin 10C includes a rectangular widened portion 13C which is defined by a pressed surface 131C as an upper surface, a locking surface 132C as a lower surface, and a side surface 133C.

Similar to the press-fit sheet 20B, the through-hole 21 of the press-fit sheet 20C includes a first hole portion 21*a* and a second hole portion 21*b*. The second hole portion 21*b* according to the present embodiment is a cylindrical columnar space whose diameter is larger than the diameter of the first hole portion 21*a*. The second hole portion 21*b* is formed as a space that accommodates the widened portion 13C. Furthermore, the second hole portion 21*b* of the press-fit sheet 20C is provided with a pressing surface 22C that is disposed to face the pressed surface 131C of the widened portion 13C in a state in which the press-fit pin 10C is held in the press-fit sheet 20C. When press-fitting the press-fit pin 10C into the through-hole 101, the pressing surface 22C transfers the pressing force to the pressed surface 131C of the widened portion 13C of the press-fit pin 10C.

Furthermore, in the present embodiment, the widened portion largest width dimension of the widened portion 13C of the press-fit pin 10C is set to a dimension slightly larger than the diameter of the second hole portion 21*b* of the press-fit sheet 20C. Thus, when the press-fit pin 10C is inserted into the through-hole 21 of the press-fit sheet 20C, the press-fit pin 10C may be held on the press-fit sheet 20C without being dropped by its own weight. Similar to the aforementioned embodiments, the press-fit pin 10C may be temporarily fixed to the press-fit sheet 20C by glue or an adhesive tape.

In the present embodiment, when the press-fit pin 10C is press-fitted into the through-hole 101 of the circuit board 100, the pressing force transferred via the press-fit jig 40 is transferred from the pressing surface 22C of the press-fit sheet 20C to the pressed surface 131C of the widened portion 13C. That is, since the pressed surface 131C of the press-fit pin 10C is pressed by the pressing surface 22C of the press-fit sheet 20C, the press-fit portion 11 of the press-fit pin 10C is press-fitted into the through-hole 101. In the present embodiment, the pressed surface 131C of the widened portion 13C is an exemplary pressed portion. The pressing surface 22C of the press-fit sheet 20C is an exemplary pressing portion. Even in the present embodiment, the presence or absence of buckling in the press-fit pin 10C may be easily confirmed by a visual observation by removing the press-fit sheet 20C from the press-fit pin 10C after the press-fit pin 10C is press-fitted.

Next, the housing 30C according to the present embodiment will be described with reference to FIG. 23. The housing 30C is different from the housing 30B according to Embodiment 3 in terms of the shape of the mounting hole 33. Specifically, the housing 30C includes a pin insertion portion 330 configured to accommodate the connection pin portion 14 of the press-fit pin 10C and a first accommodation portion 331C configured to accommodate the widened portion 13C. The first accommodation portion 331C of the housing 30B is a cylindrical columnar space.

Even in the present embodiment, the housing 30C is mounted to the press-fit pin 10C from which the press-fit sheet 20C has been removed. That is, the press-fit pin 10C is mounted to the mounting hole 33 of the housing 30C while pressing and elastically deforming the edge wall 334 of the pin insertion portion 330, which is positioned at the side of a lower surface 300*a* of the housing 30C, by the widened portion 13C. Then, the widened portion 13C of the press-fit pin 10C moves over the edge wall 334, and the locking surface 132C of the widened portion 13C locks the edge wall 334 of the housing 30C. Thus, the housing 30C is suppressed from being inadvertently removed from the press-fit pin 10C.

In the press-fit pin 10C according to the present embodiment, the pressed surface 131C of the widened portion 13C is orthogonal to the axial direction of the press-fit pin 10C. Thus, at the time of press-fitting the press-fit pin 10C, the pressing force applied from the press-fitting device may be efficiently transferred to the pressed surface 131C of the press-fit pin 10C by the pressing surface 22C of the press-fit sheet 20C.

While the connectors according to the embodiments have been described above, various modifications, improvements, and combinations may be made in the respective embodiments. Furthermore, as illustrated in the second to fourth embodiments, the widened portion of the press-fit pin 10 may have different shapes. In addition, the housing may have the function of the press-fit sheet according to each of the embodiments and may also serve as the press-fit sheet.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. A connector comprising:

a press-fit pin including a connection pin portion formed at a distal end of the press-fit pin, a widened portion that is coupled to the connection pin portion and has a width larger than a diameter of the connection pin portion, a flange portion that is coupled to the widened portion and has a width larger than a diameter of the widened portion, and a press-fit portion that is coupled to the flange portion and configured to be press-fitted into a through-hole of a circuit board; and a housing including a bottom portion, a sidewall portion extending upward from the bottom portion, a pin insertion portion formed in the bottom portion that allows the connection pin portion of the press-fit pin to pass therethrough, a first accommodation portion formed in the bottom portion and configured to accommodate the widened portion of the press-fit pin, and a second accommodation portion formed in the bottom portion and configured to accommodate the flange portion of the press-fit pin, wherein the press-fit portion of the press-fit pin protrudes from a surface of the bottom portion.

* * * * *